US009476422B2

(12) United States Patent
Walters

(10) Patent No.: US 9,476,422 B2
(45) Date of Patent: Oct. 25, 2016

(54) SLIDING VANE POSITIVE DISPLACEMENT PUMP HAVING A FIXED DISC CONFIGURATION TO REDUCE SLIP PATHS

(71) Applicant: Michael D Walters, Hudsonville, MI (US)

(72) Inventor: Michael D Walters, Hudsonville, MI (US)

(73) Assignee: Delaware Capital Formation, Inc., Wilmington, DE (US)

( * ) Notice: Subject to any disclaimer, the term of this patent is extended or adjusted under 35 U.S.C. 154(b) by 366 days.

(21) Appl. No.: 13/870,092

(22) Filed: Apr. 25, 2013

(65) Prior Publication Data

US 2013/0309114 A1 Nov. 21, 2013

Related U.S. Application Data

(60) Provisional application No. 61/647,276, filed on May 15, 2012.

(51) Int. Cl.

| | |
|---|---|
| ***F01C 21/08*** | (2006.01) |
| ***F04C 27/00*** | (2006.01) |
| ***F04C 2/00*** | (2006.01) |
| ***F04C 2/344*** | (2006.01) |
| ***F04C 15/00*** | (2006.01) |

(52) U.S. Cl.

CPC ..... *F04C 2/00* (2013.01); *F01C 21/08* (2013.01); *F04C 2/3442* (2013.01); *F04C 15/0023* (2013.01); *F04C 2240/20* (2013.01)

(58) Field of Classification Search

CPC ..... F01C 1/321; F01C 1/344; F01C 21/08; F01C 21/108; F04C 15/003; F04C 15/0007–15/0015; F04C 15/0023; F04C 2/00; F04C 2/321; F04C 2/344–2/3445; F04C 18/00; F04C 18/321; F04C 18/344–18/3445

USPC ..... 418/145–148, 259–269

See application file for complete search history.

(56) References Cited

U.S. PATENT DOCUMENTS

| | | | | |
|---|---|---|---|---|
| 2,205,705 | A * | 6/1940 | Whitehurst | 418/142 |
| 2,536,938 | A * | 1/1951 | Hunter | F03C 2/30 418/235 |
| 2,714,372 | A * | 8/1955 | Williams | 418/173 |
| 2,762,340 | A * | 9/1956 | Roggenburk | 418/133 |
| 3,626,265 | A | 12/1971 | Kraakman | |
| 3,954,358 | A * | 5/1976 | Normandin | 418/151 |
| 4,397,620 | A * | 8/1983 | Inagaki | F01C 21/08 418/141 |
| 4,526,524 | A * | 7/1985 | Kondo | F01C 21/08 418/255 |
| 4,746,280 | A | 5/1988 | Wystemp et al. | |
| 6,439,868 | B1 | 8/2002 | Tomoiu | |
| 7,134,855 | B2 | 11/2006 | Bohr | |
| 7,316,551 | B2 | 1/2008 | Bohr | |
| 2009/0041604 | A1* | 2/2009 | Boskovic et al. | 418/141 |

FOREIGN PATENT DOCUMENTS

| | | | |
|---|---|---|---|
| FR | 545947 | A * | 10/1922 |
| GB | 388990 | A * | 3/1933 |

* cited by examiner

*Primary Examiner* — Thomas Denion
*Assistant Examiner* — Laert Dounis
(74) *Attorney, Agent, or Firm* — Miller Canfield Paddock and Stone; Mark L Maki

(57) ABSTRACT

A sliding vane, positive displacement pump is provided which uses a fixed disc configuration wherein a rotor includes a pair of discs affixed to opposite faces of the rotor so as to rotate with the rotor/shaft. Preferably, the discs each have an outer diameter proximate the outer diameter of the rotor and define an outer disc surface which faces radially outwardly towards an opposing, inside surface of the pump head or other casing structure. A dynamic seal is provided along the outside disc diameter which eliminates the formation of slip between end surfaces. The path of fluid traveling from the high pressure pump side near the outlet to the low pressure side of pump near the inlet is controlled with a radial clearance that is defined between the OD of each disc and the ID of the stationary head. This effectively eliminates direct slip paths extending radially across axially-directed end faces.

21 Claims, 16 Drawing Sheets

SLIDING VANE POSITIVE DISPLACEMENT PUMP HAVING A FIXED DISC CONFIGURATION TO REDUCE SLIP PATHS

CROSS REFERENCE TO RELATED APPLICATIONS

This application asserts priority from provisional application 61/647,276, filed on May 15, 2012, which is incorporated herein by reference.

FIELD OF THE INVENTION

The invention relates to a sliding vane positive displacement pump and more particularly, to a pump having an improved rotor construction which rotates within a pump casing to effect pumping.

BACKGROUND OF THE INVENTION

In sliding vane positive displacement pumps, such pumps are used in a number of different industrial and commercial processes to force fluid movement from a first location to a second location. One example of a sliding vane pump of this type is illustrated in FIGS. 1 and 2.

The prior art sliding vane pump 10 includes a housing or casing 11 that defines a hollow section which is shaped to define a pump chamber 12. Typically, the pump chamber 12 is defined by a liner 13 that is stationarily supported in the casing 11 and has an eccentric, non-circular cross-sectional profile. The pump chamber 12 is supplied with process fluid through an inlet 15 and discharges from an outlet 16, which inlet 15 and outlet 16 respectively open into and out of the pump chamber 12.

In prior art pumps 10 of this type, flat, stationary discs 17 and 18 define the front and rear ends of the chamber 12. The discs 17 and 18 are stationary and are confined axially between a first head 21 and a second head 22 which generally enclose the front and rear ends of the pump chamber 12. The first and second heads 21 and 22 are affixed to the casing 11 by fasteners and sandwich the discs 17 and 18 and the liner 13 therebetween so as to prevent movement of these components during shaft rotation.

A shaft 24 extends through the casing 11 and has an inboard first end 25, which projects from the casing 11 and is driven by a motor or other motive means, and an outboard second end 26. In this design, the second shaft end 26 terminates within the casing 11 and is rotatably supported by the outboard head 22. The shaft ends 25 and 26 are supported by bearings 27 and 28 which are respectively supported within corresponding channels in the heads 21 and 22 and rotatably support the shaft 24 to permit rotation thereof. The bearings 27 and 28 are retained axially in position by bearing locknuts 30 and 31, which thread onto the shaft ends 25 and 26, and in turn, are enclosed by bearing covers 32 and 33, which are removably affixed to the heads 21 and 22.

The shaft 24 extends through the pump chamber 12 by extending axially through shaft holes 35 and 36 which are formed in the center of the discs 17 and 18. A small radial gap is defined between the inside diameter of the shaft holes 35 and 36 and the opposing outside shaft surface 37, and while some process fluid might leak axially out of the pump chamber 12 along the radial gaps, mechanical seals 40 and 41 are provided which seal radially between the casing 11 and shaft 24 to prevent leakage of such fluid out of the pump 10.

To effect pumping, attached to the shaft 24 is a rotor 45 that is secured to the shaft 24 so as to rotate in unison therewith. The rotor 45 is located within the pump chamber 12 to draw fluid through the inlet 15 and discharge process fluid through the outlet 16. The rotor 45 includes vane slots 46 which are spaced circumferentially from each other. These vane slots 46 open radially outwardly, and also open axially through the opposite rotor faces 45A.

Normally, vanes (not shown in FIGS. 1 and 2) project outwardly from the slots 46 in the rotor 45, although the vanes are movable radially into and out of the slots 46. The vanes are confined axially within the slots 46 by the stationary discs 17 and 18 which are positioned axially adjacent to the rotor 45. As the shaft 24 and rotor 45 turn, the volume of the space in the chamber 12 between circumferentially adjacent vanes and the radially opposed surfaces of the rotor 45 and liner 13 (each space referred to as a fluid cavity), cyclically increases and decreases due to the eccentric profile defined by the liner 13. As a result of the increase in volume of a fluid cavity as it begins to travel away from the inlet 15, a suction is formed in the cavity. The suction draws fluid into the fluid cavity through the inlet 15. As the rotor continues to turn, owing to the geometry of the pump chamber 12 and liner 13, the volume of the fluid cavity decreases as it travels towards the outlet 16. As a result of the volume of the cavity decreasing, the fluid in the cavity is discharged through an outlet 16.

In the known configuration, the liner 13 and discs 17 and 18 remain stationary while the rotor 45 rotates relative thereto. The discs 17 and 18 are located at the opposite ends of the rotor 45 and respectively include disc faces 17A and 18A which face axially toward the opposing rotor faces 45A. Due to the relative rotation therebetween, a small axial clearance or end clearance is required between the disc faces 17A and 18A and the rotor faces 45A. Typically, the discs 17 and 18 and the rotor 45 are metallic, and as such, contact must be avoided during shaft rotation, wherein such face contact can cause galling between these components. In these pump designs, it thereby may be desired to provide expensive coatings on the heads and discs 17 and 18 to prevent galling damage.

Due to this end clearance, however, disadvantages are present with known pump designs. More particularly, the opposed end faces 17A, 18A and 45A and the end clearances therebetween generate dynamic sealing due to the relative movement of the rotor end faces 45A. As a result, the dynamic movement of the components impedes leakage of fluid between such end faces 17A, 18A and 45A. However, these end clearances still define paths that extend facewise across the end faces 45A and that allow pressurized fluid to slip from the outlet side to the inlet side of the rotor 45 which thereby reduces the overall hydraulic efficiency of the pump 10, since such fluid is not discharged through the outlet 16 but instead returns to the inlet side and is then displaced again by the rotor 45 and vanes back towards the outlet 16. This loss is conventionally known as slip.

While it is desirable to minimize the end clearance to minimize slip, this minimizing of the axial clearance space results in tight dimensional tolerances for the pump components and requires precise positioning of the rotor 45 between the two discs 17 and 18. In one negative aspect of this known design, the axial location of the rotor 45 and discs 17 and 18 must be precise.

In a second aspect, the rotor 45 has a much larger diameter than the shaft 24 and the rotor faces 45A and disc faces 17A and 18A extend radially a significant dimension. In other words, the outside diameters (OD) of the rotor 45 and discs 17 and 18 are spaced radially outwardly of the shaft by a significant distance, such that the rotor faces 45A and disc faces 17A and 18A have a significant radial width as measured radially outwardly from the shaft 24 to the OD of each disc 17/18 and rotor 45. To maintain a constant and uniform axial clearance facewise across this radial width, it also is important that the opposed faces 17A and 18A be parallel to each other and perpendicular to the shaft axis. The large diameter of the rotor 45 relative to the shaft 24 creates a need for a tight or precise perpendicularity and machining tolerances between the rotor 45 and shaft 24 and between the heads 21 and 22 and respective discs 17 and 18.

Even if the end clearances are minimized, the overall area or radial width of the end clearances is still relatively large and this defines significant area over which slip can occur. Hence, these pump designs still exhibit disadvantages resulting from the slip which occurs between the stationary pump components and the rotor 45.

In other pump designs as disclosed in U.S. Pat. No. 7,134,551 (Bohr) and U.S. Pat. No. 7,316,551 (Bohr), these designs relate to variations of a rotary vane, positive displacement pump. One such pump embodying this invention has a rotor that is attached to the front end of the complementary shaft. An inboard disc is located between the rotor and shaft to form a first end surface against which the pump vanes seat. In another such pump, a second disc may be fitted over the opposed front end of the rotor to form the second end surface against which the vanes seat.

In another such pump, a second rotor may be fixed with respect to the opposed front face of the second disc. In another such pump, separate pump chambers are provided for corresponding rotors. In another such pump, a third disc may be fitted over the opposed front end of the second rotor. The discs rotate in unison with the rotor(s) and the shaft. These designs do not have a bearing supported forward end.

In these pump designs, the discs extend radially beyond the outside rotor diameter and as such, the discs have disc faces which face towards the side faces of a liner. The discs rotate relative to the liner and define end faces which face axially toward liner end faces. These opposed faces are relatively movable, and create clearance spaces that can permit slip therebetween. Further, the axial positioning of the discs and liner must be maintained precisely. Here again, it is desirable to provide a pump design which provides improved performance over these known pump designs.

SUMMARY OF THE INVENTION

The invention relates to a sliding vane, positive displacement pump which includes an inventive bolted or fixed disc configuration wherein the discs are fixed to and rotate with the rotor during shaft rotation. In this design, the rotor includes a pair of discs affixed to opposite faces of the rotor so as to rotate with the rotor/shaft. The discs each have an outer diameter proximate the outer diameter of the rotor and define an outer disc surface which faces radially outwardly towards an opposing, inside surface, which preferably is defined by an inside diameter of the head or other structure of the pump casing. Therefore, a dynamic seal is provided along the outside disc diameter instead of axially-directed faces.

The discs are most likely to be affixed to the rotor using fasteners but could be affixed using other means or made from one piece with the rotor or shaft.

With this design, the discs rotate with the rotor and the end clearances are eliminated. This thereby eliminates the formation of slip between such end surfaces. More particularly in this design, the path of fluid traveling from the high pressure pump side near the outlet to the low pressure side of pump near the inlet is controlled with a radial clearance that is defined between the OD of each disc and the ID of the stationary head. This effectively eliminates the direct slip path extending radially across end faces of a rotor and the stationary discs that is present in the known design (FIGS. 1 and 2). This OD sealing method of the invention creates a better seal due to more torturous flow path (higher pressure loss) as well as a potential dynamic sealing due to boundary layer formation during operation.

The design of the invention provides a number of benefits. For example, this provides an improved method to reduce pumpage lost due to slip between discharge and inlet sides of a positive displacement vane pump which improves hydraulic efficiency. Since the axial end clearances are eliminated, the reliance upon the radial clearance at the OD of each disc allows for larger machining tolerances and/or internal pump clearances to improve machining cost and assembly. This also improves pump durability when it is necessary to use materials that are sensitive to galling such as nonmetallic or dissimilar metals used for the discs and head. There also is a lower amount of vane contact/wear on the vane width when the rotor/shaft and discs are axially located and set during assembly. With the known configuration of FIGS. 1 and 2, the ends of the vanes interface with the stationary discs and there could be high relative velocity between the vane ends and each stationary disc/head.

Additional advantages also exist. For example, the diameter of the rotor still may be much larger than a shaft. The discs are bolted or otherwise affixed to the rotor and rotate with the rotor shaft which eliminates the axial end faces. Since the disc OD is defined and located within the head, the dynamic clearance is now defined by and controlled on the OD of the disc and the ID of the head. These diameters can be easily machined in one operation which allows for precise location and size of the opposing head and disc diameters.

Further, clearances can be more precisely controlled, and perpendicularity tolerance of the rotor is less important since the end clearances are eliminated in the inventive design. Also, locating the clearances on the diameter creates a torturous flow path which improves flow lost due to slip. Still further, axial pump clearances can be increased which improves assembly and field repairability.

In addition to the preferred design described herein, other alternate configurations are disclosed. For example, the disc OD can be designed to further eliminate slip such as by providing a helical dynamic excluder (pump) or a labyrinth seal (multiple steps). Further, the discs and shaft may be integrated into a single piece, wherein the rotor would be clamped between two axial-extending shaft sections.

If desired, discs can be non-metallic or dissimilar metals while still avoiding galling or damage. If desired, metallic discs may be used depending on application, and providing a relatively small disc thickness in relation to metallic rotor reduces issues with thermal expansion of plastics used in metallic housings.

While fasteners are used, each disc may be affixed using another method (adhesive, weld, thread onto shaft or rotor). Also, holes may be provided in the disc which holes may be used to pressure energize vanes or a seal cavity.

In one design, the rotor/disc assembly may not be axially affixed to the shaft. In this configuration, the rotor/disc assembly floats axially on the shaft and would be rotationally driven using a key, pin, or spline between the shaft and rotor. The axial location of the pump rotor/disc assembly in relation to the heads would be accomplished by precisely controlling the axial width of the rotor disc assembly to ensure that the vanes will not contact the heads during pump operation.

Other objects and purposes of the invention, and variations thereof, will be apparent upon reading the following specification and inspecting the accompanying drawings.

Figure 1:
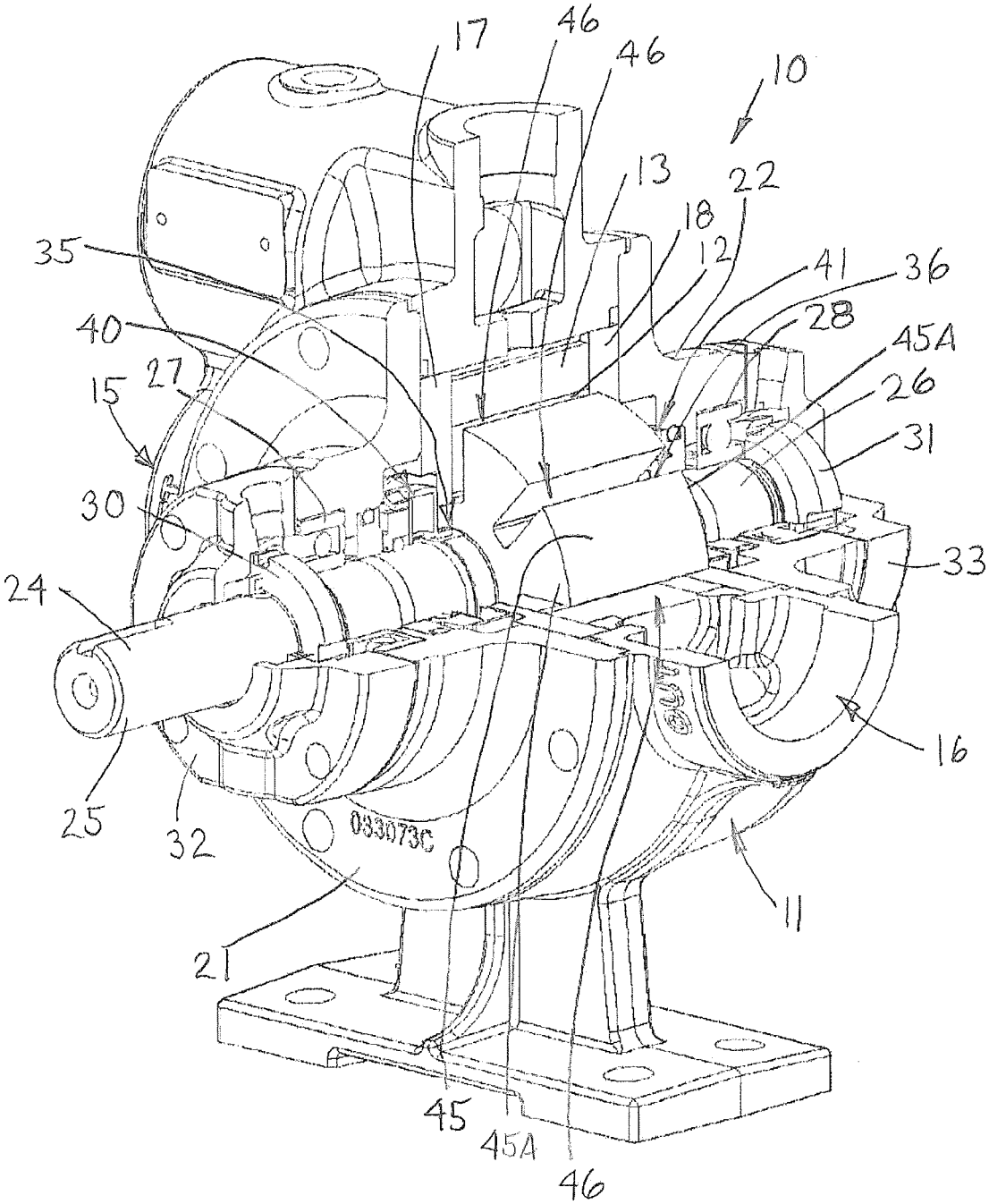
FIGURE 1 PRIOR ART
FIG. 1 is a partially cut-away, perspective view of a prior art positive displacement pump with sliding vanes.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Figure 3:
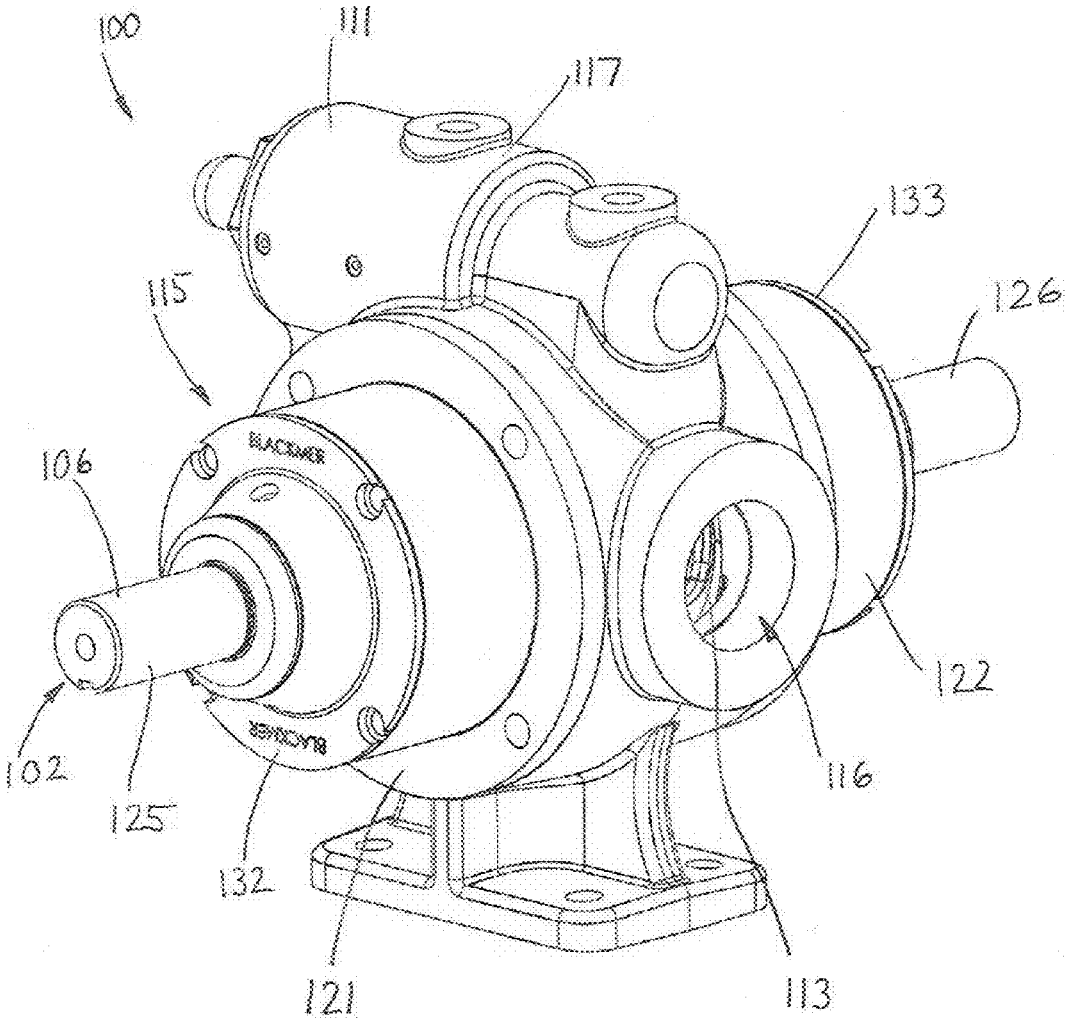
FIG. 3 is a perspective view of a sliding vane, positive displacement pump of the invention.
Figure 4:
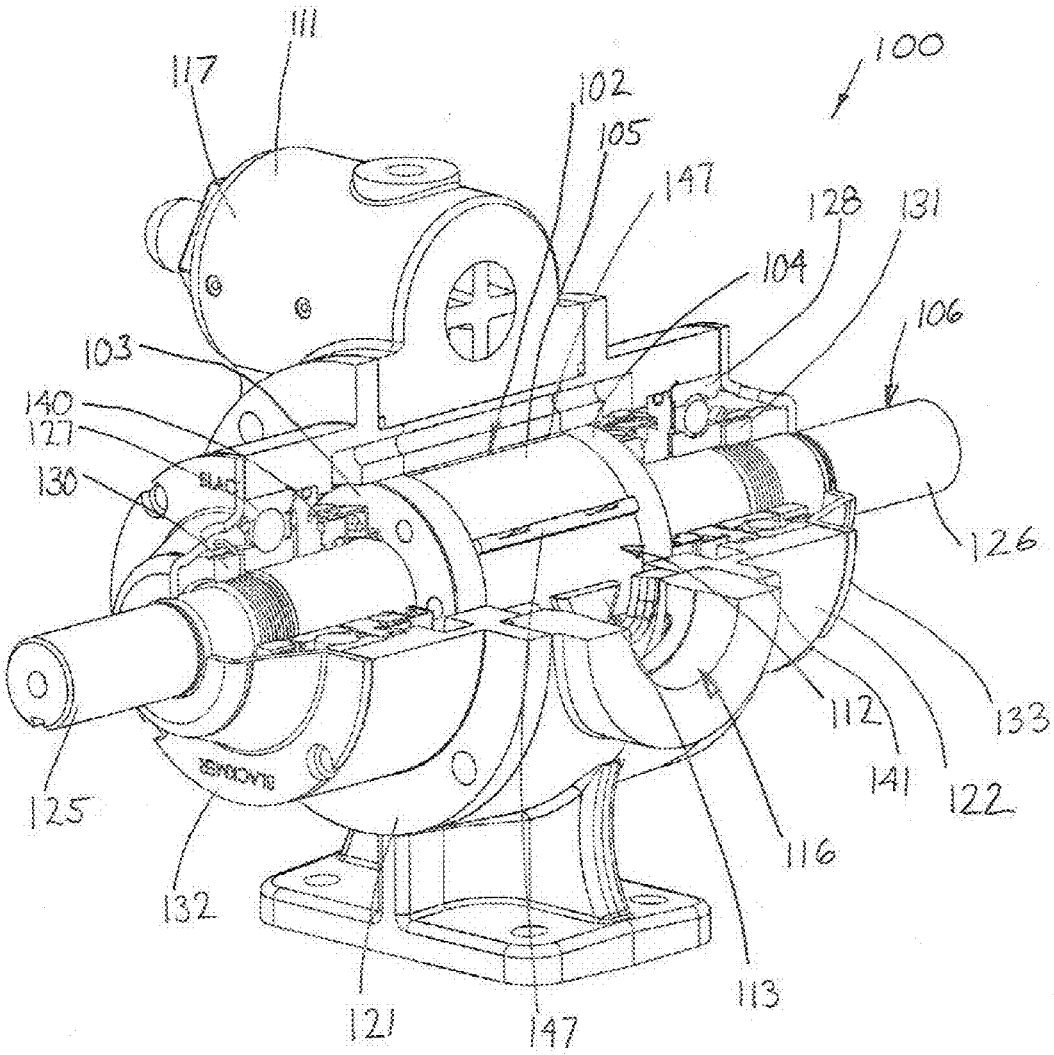
FIG. 4 is a perspective view in cut-away cross-section.
Figure 5:
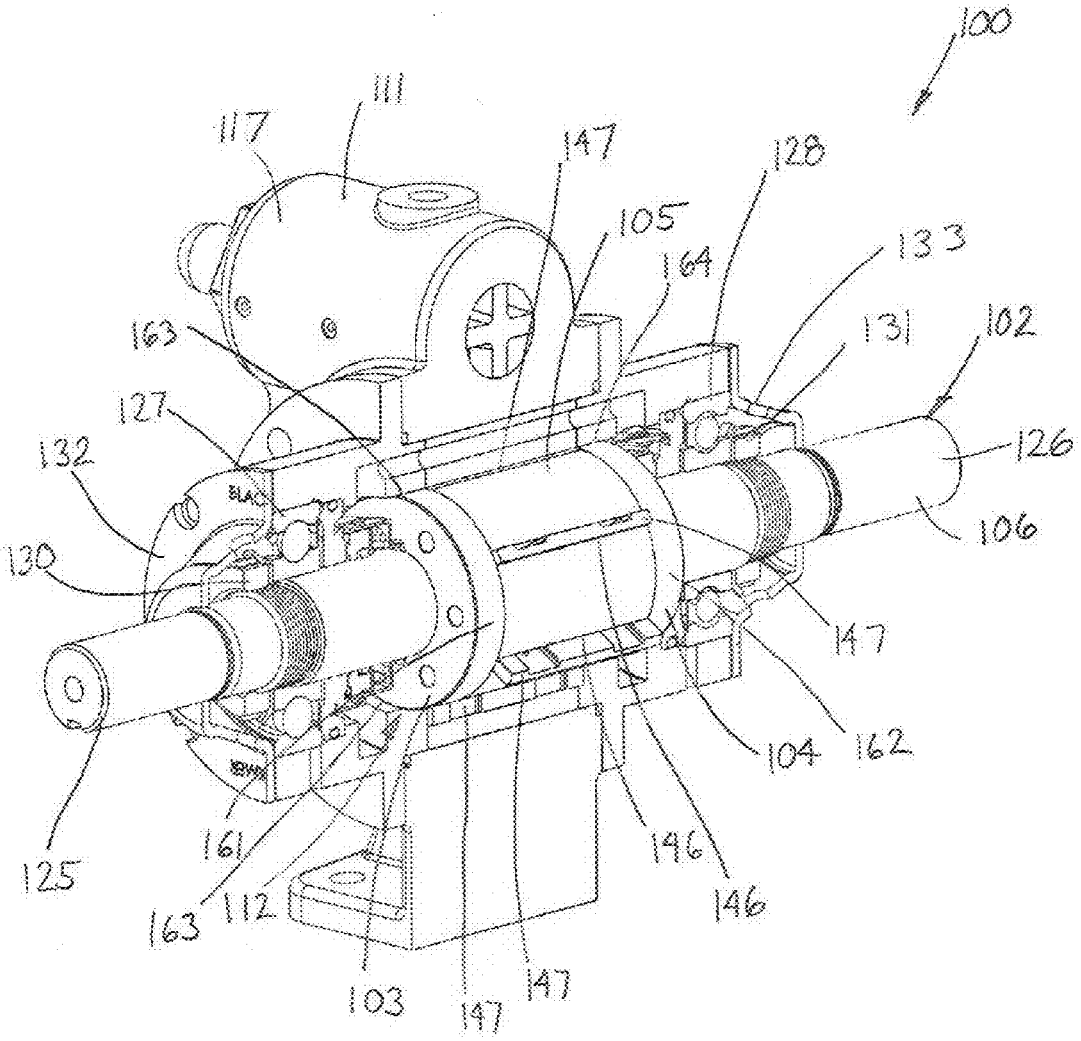
FIG. 5 is a perspective cross-sectional view of the inventive pump.

Referring to FIGS. 3 and 4, the invention relates to a sliding vane, positive displacement pump 100 which includes an inventive bolted or fixed disc rotor/shaft assembly 102 wherein two discs 103 and 104 are fixed to and rotate with the rotor 105 during rotation of a shaft 106.

Figure 8:
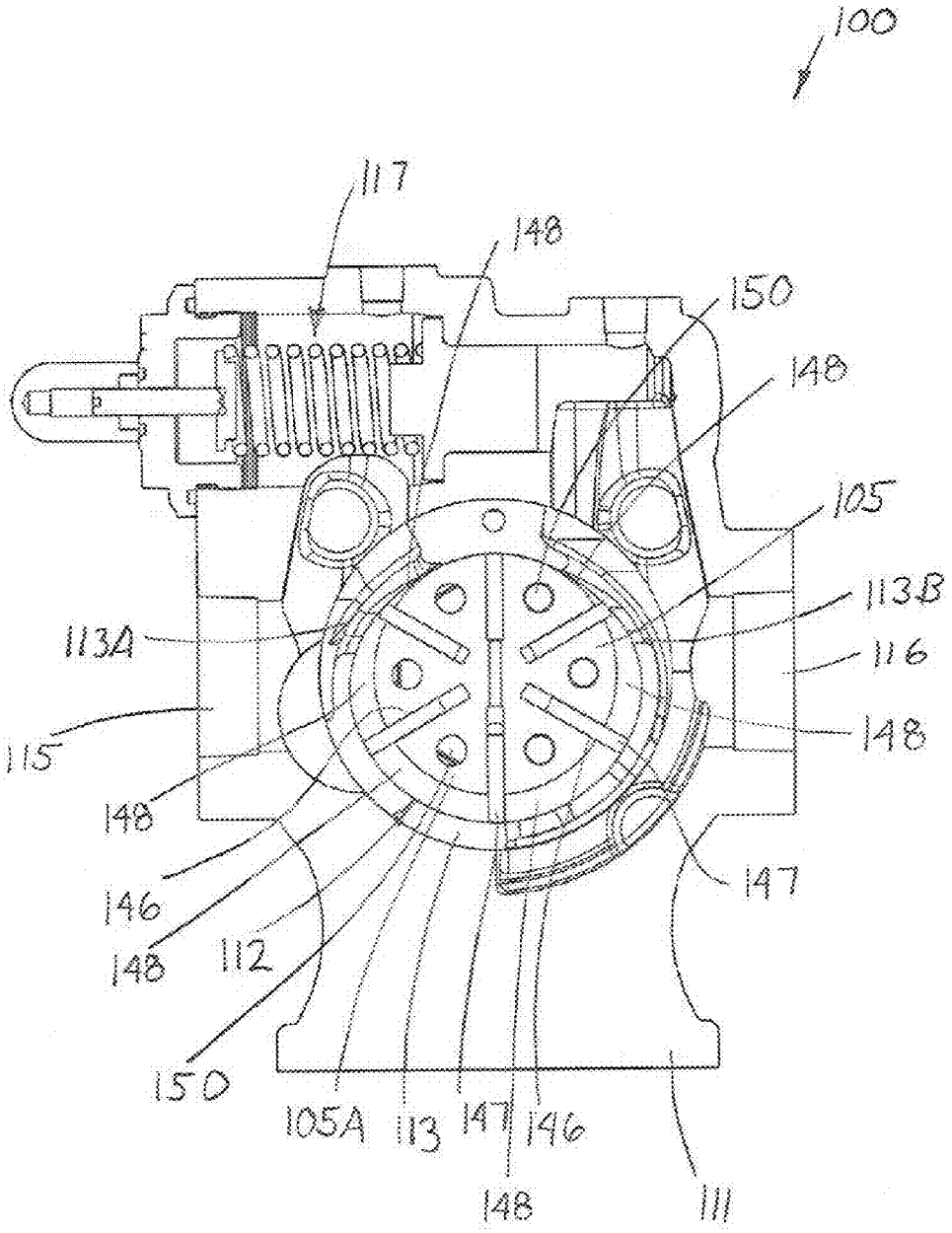
FIG. 8 is an end cross-sectional view thereof.

Generally as to FIGS. 3-6, the sliding vane pump 100 includes a housing or casing 111 that defines a hollow section which is shaped to define a pump chamber 112. Typically, the pump chamber 112 is defined internally by a liner 113 that is stationarily supported in the casing 111 and has an eccentric, non-circular cross-sectional profile as seen in FIG. 8. As best seen in FIG. 8, the pump chamber 112 is supplied with process fluid through an inlet 115 and discharges from an outlet 116, which inlet 115 and outlet 116 respectively open radially into and out of the pump chamber 112 through the liner 113. The liner 113 has a generally cylindrical shape that includes radial fluid ports or passages 113A and 113B which respectively communicate with the inlet 115 and outlet 116.

The central portion of the liner 113 is hollow and opens axially through opposite ends so as to receive the rotor shaft assembly 102 therein while permitting both ends of the shaft 106 to project axially out of the liner 113. The upper portion of the casing 111 includes a spring-biased relief valve 117 (see for example FIG. 8), a description of which is not critical to an understanding of the current invention.

The discs 103 and 104 are located at the front and rear ends of the chamber 112, wherein the open ends of the chamber 112 are enclosed by a first inboard head 121 and a second outboard head 122. The first and second heads 121 and 122 are affixed to the casing 111 by fasteners and sandwich the liner 113 therebetween so as to prevent movement of the liner 113 during shaft rotation.

Referring to FIGS. 4-7, the shaft 106 extends through the casing 111 and has an inboard first end 125, which projects from the casing 111 and is driven by a motor or other motive means, and an outboard second end 126, which terminates out of the opposite end of the casing 111 and is rotatably supported by the outboard head 122. The shaft ends 125 and 126 are supported by bearings 127 and 128 which are respectively supported within corresponding channels in the heads 121 and 122 and rotatably support the shaft 106 to permit rotation thereof. The bearings 127 and 128 are retained axially in position by bearing locknuts 130 and 131 and lock washers 130A and 131A, which thread onto the shaft ends 125 and 126, and in turn, are enclosed by bearing covers 132 and 133, which are removably affixed to the heads 121 and 122.

The shaft 106 extends through the pump chamber 112 wherein mechanical seals 140 and 141 are provided at the opposite pump ends. The mechanical seals 140 and 141 seal between the casing 111 and shaft 106 to prevent leakage of such fluid out of the pump 100 along the shaft ends 125 and 126. More specifically, the mechanical seals 140 and 141 cooperate with the respective shaft end 125 and 126 and respective pump head 121 and 122 and prevent leakage of pump fluid along the shaft ends 125 and 126.

To effect pumping, the rotor shaft assembly 102 includes the shaft 106 and includes a rotor 105 that is secured to the shaft 106 so as to rotate in unison therewith. The assembly 102 further includes the discs 103 and 104 which are affixed to the opposite side faces of the rotor 105 so as to also rotate as will be described further herein.

As to the rotor 105, the rotor 105 is located within the hollow liner 113 in the pump chamber 112 to draw fluid through the inlet 115 during shaft rotation and discharge process fluid through the outlet 116. The rotor 105 includes vane slots 146 which are spaced circumferentially from each other and open radially outwardly. These vane slots 146 also open axially through the opposite rotor faces 105A (FIG. 8). In the illustrated embodiment, six vane slots 146 are provided which are circumferentially spaced apart at equal angular distances from each other.

Each slot 146 includes a radially-slidable vane 147 which can retract into and project out of the respective slot 146, or in other words, the vanes 147 are movable radially into and out of the slots 146. The vanes 147 are confined axially within the slots 146 by the rotor-attached discs 103 and 104 which are affixed to the opposite axial ends of the rotor 105. As the shaft 106 and rotor 105 turn, the volumes of spaces or cavities 148 (FIG. 8) that are defined circumferentially between adjacent vanes 147 and radially between the opposed surfaces of the rotor 105 and liner 113, referred to as a fluid cavities, cyclically increase and decrease due to the eccentric profile defined by the liner 113. As a result of the volume of a fluid cavity increase in the spaces 148, a suction is formed in the cavity 148 closest to the inlet 115. The suction draws fluid into this fluid cavity 148 through the inlet 115. As the rotor 105 continues to turn, owing to the geometry of the pump chamber 112 and liner 113, the volume of the fluid cavity 148 decreases nearer to the outlet 116. As a result of the volume of the cavity 148 decreasing, the fluid in the cavity 148 at the outlet 116 is discharged through the outlet 116. More detail will be provided relative to these cavities 148 as the discussion turns to FIGS. 9-14. For now, it will be understood that in this configuration, the liner 113 remains stationary while the rotor 105 rotates relative thereto.

With pressure differences between the inlet and outlet areas of the rotor 105, there is a normal tendency for slip to occur wherein fluid tries to leak back to the lower pressure inlet side. As noted above, slip reduces the hydraulic efficiency of a positive displacement pump.

Figure 15:
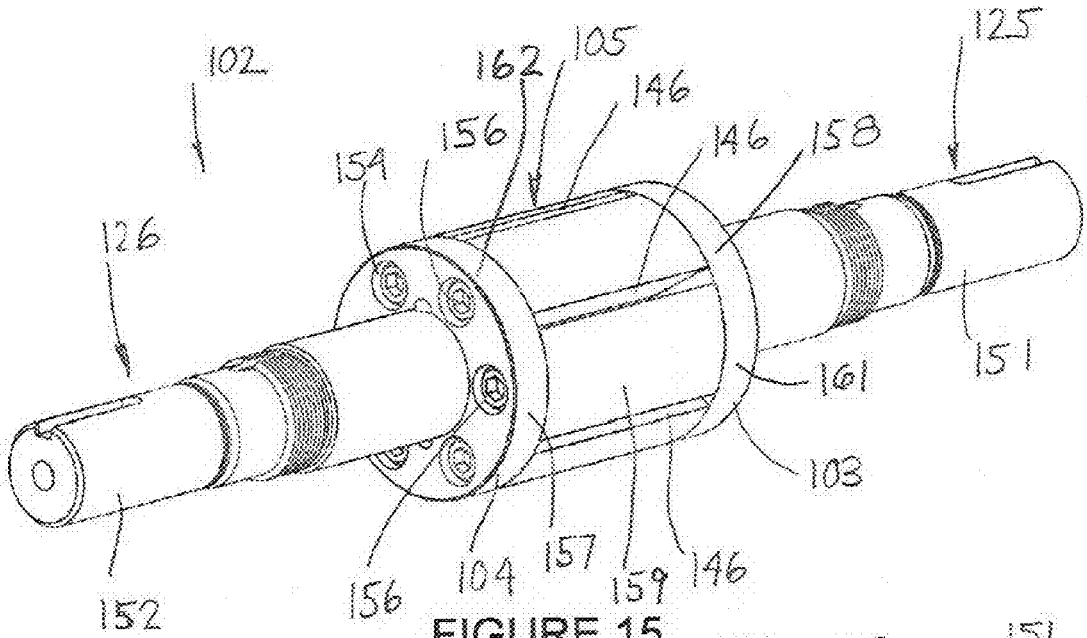
FIG. 15 is a perspective view of an alternative rotor/shaft assembly.
Figure 16:
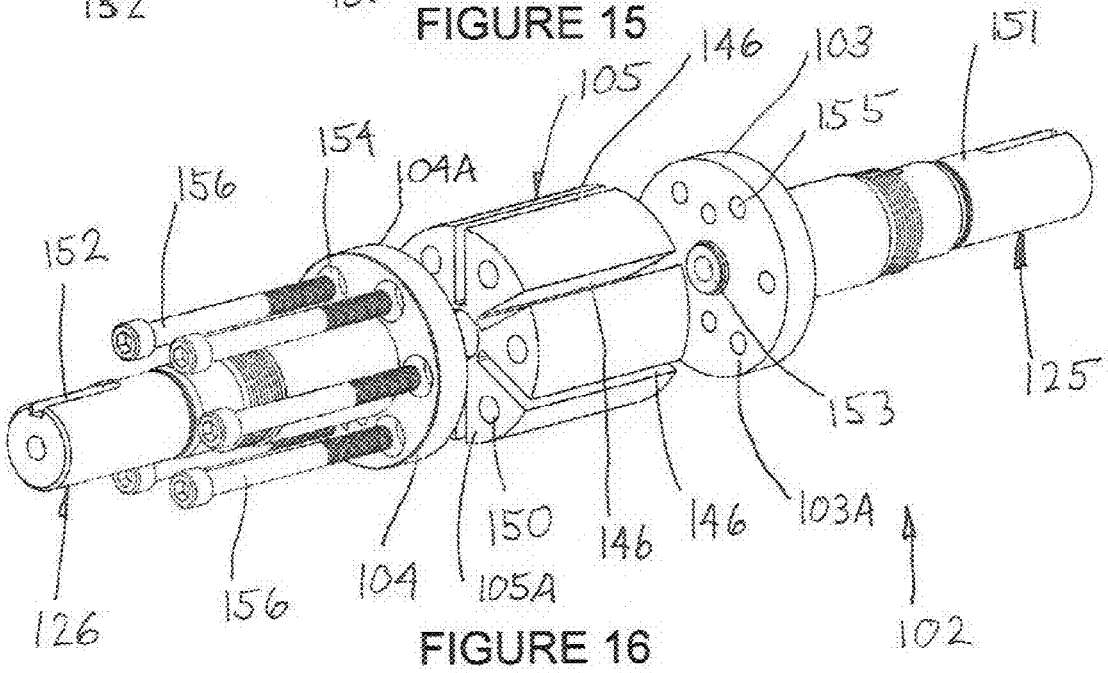
FIG. 16 is an exploded view thereof.

The present invention is an inventive, rotor-attached disc configuration wherein the discs 103 and 104 are fixed to and rotate with the rotor 105 during shaft rotation. Referring to FIGS. 15 and 16, one design for the rotor/shaft assembly 102 is shown. In this design, the rotor 105 is a separate component and includes through holes 150 which are angularly spaced apart and extend axially through the rotor body.

The discs 103 and 104 are formed as part of the shaft end sections 125 and 126 by securing the discs 103/104 to an axially-elongate, shaft part 151 and 152 through a respective fastener 156. One disc 104 includes countersunk fastener bores 154, while the other disc 103 includes threaded bore holes 155 into which fasteners 156 are threadedly engaged. When secured together, the rotor/shaft assembly 102 is formed as seen in FIG. 15.

Figure 6:
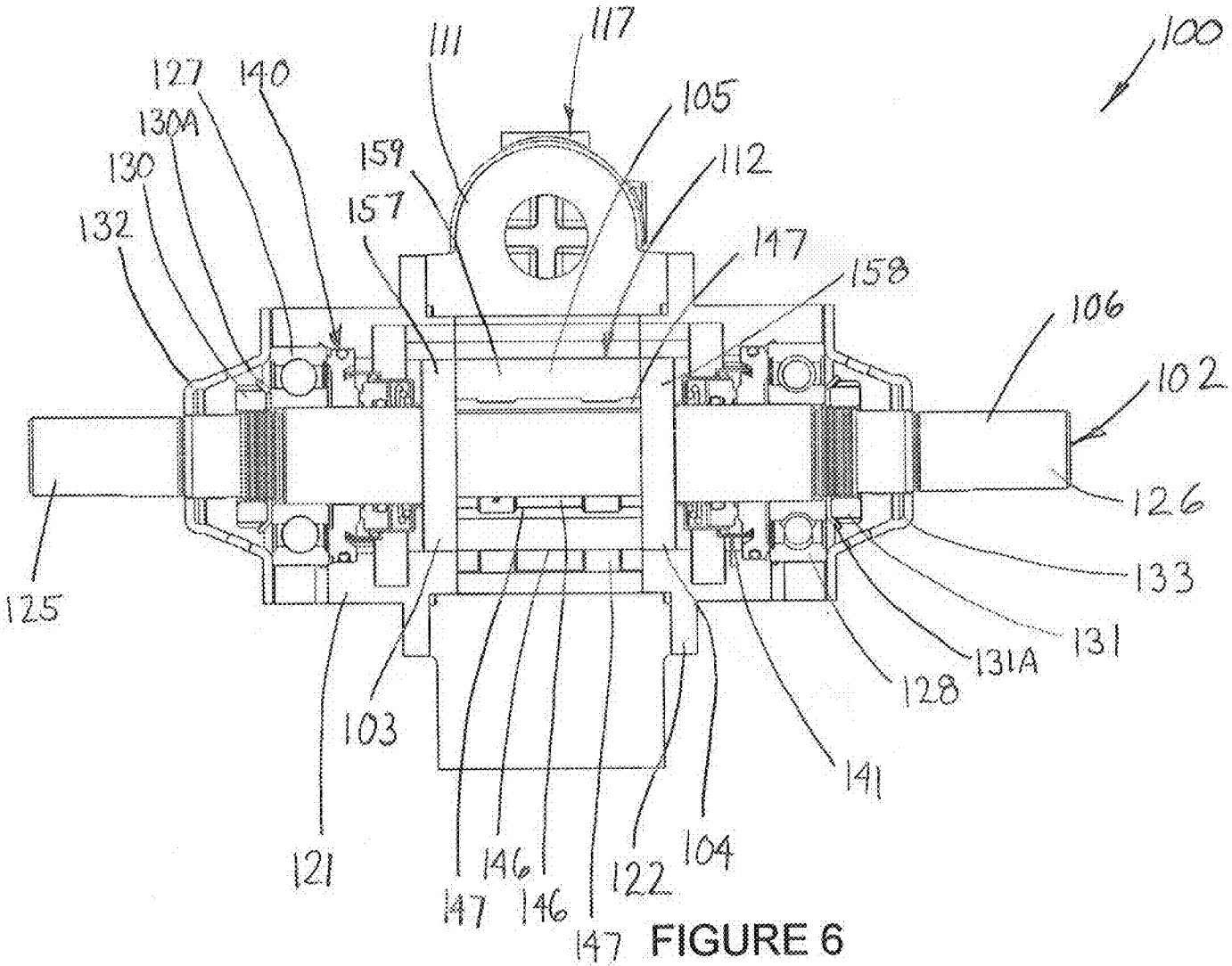
FIG. 6 is a side cross-sectional view thereof.
Figure 7:
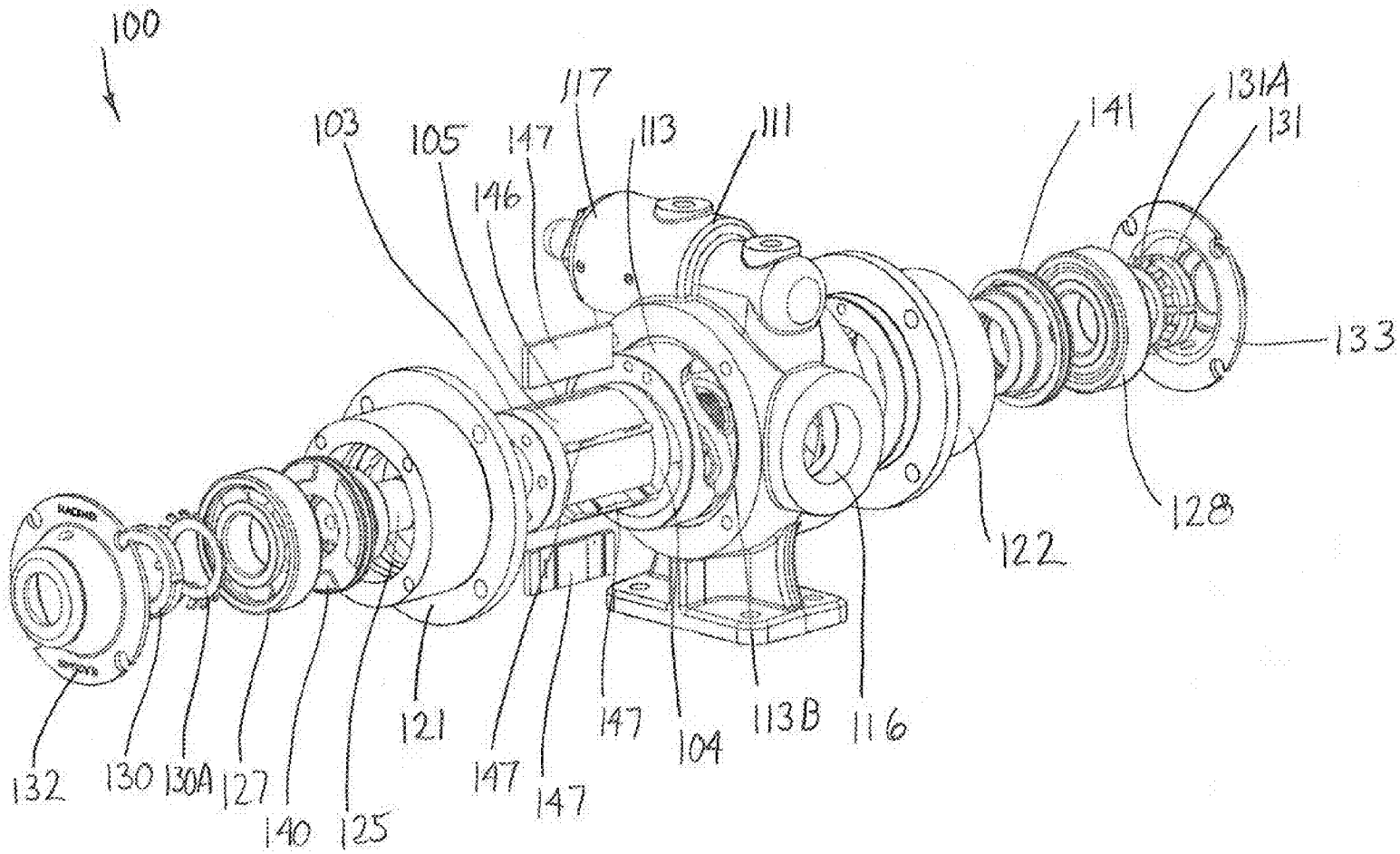
FIG. 7 is an exploded view thereof.
Figure 9:
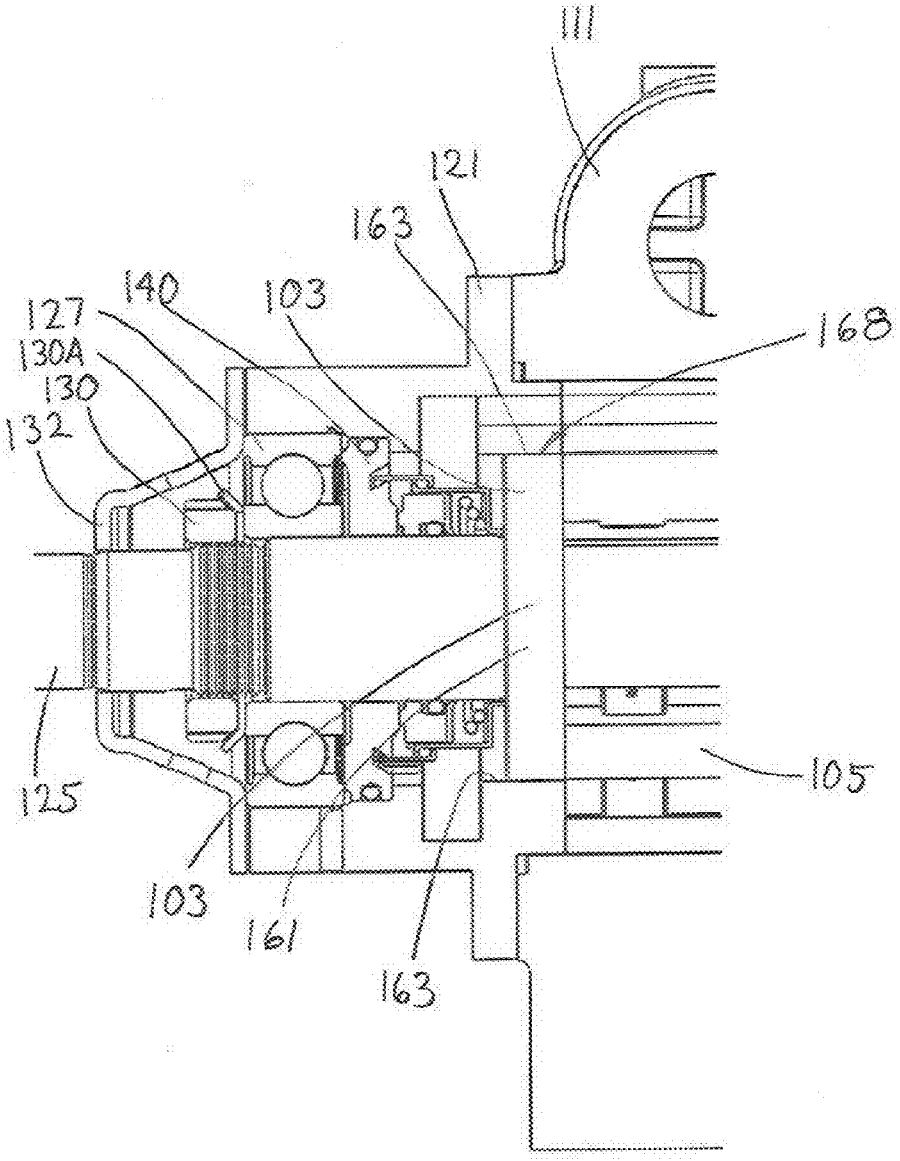
FIG. 9 is an enlarged cross-sectional view of one end of the pump.
Figure 10:
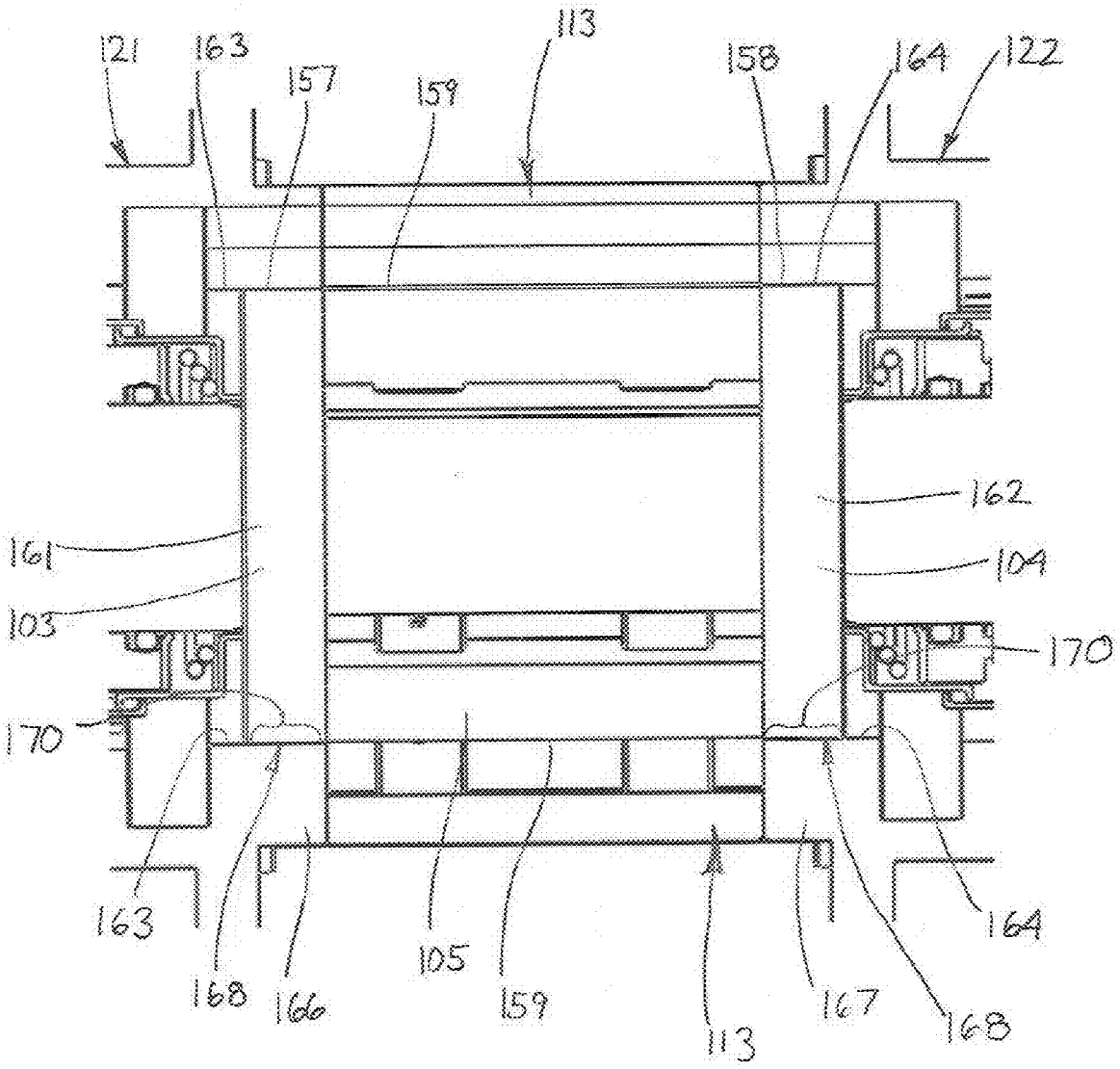
FIG. 10 is an enlarged cross-sectional view showing a rotor-shaft assembly.

In this design, the rotor 105 has the pair of discs 103/104 affixed to opposite faces of the rotor 105 so as to rotate with the rotor 105 and shaft 106. As seen in FIGS. 6 and 15, the discs 103 and 104 each have an outer diameter 157 and 158 which is proximate the outer diameter 159 of the rotor 105. Referring more specifically to FIGS. 9 and 10, each disc 103/104 defines an outer disc surface 161/162 which faces radially outwardly towards an opposing, inside head surface 163/164. Preferably, the inside head surfaces 163 and 164 are defined by an inside diameter of an annular shoulder 166 or 167 of the respective head 121 or 122. The outer disc surfaces 161 and 162 are disposed in radially opposed relation with the inside facing head surfaces 163 and 164, wherein a small radial clearance 168 is formed therebetween to avoid surface contact during shaft rotation.

Figure 11:
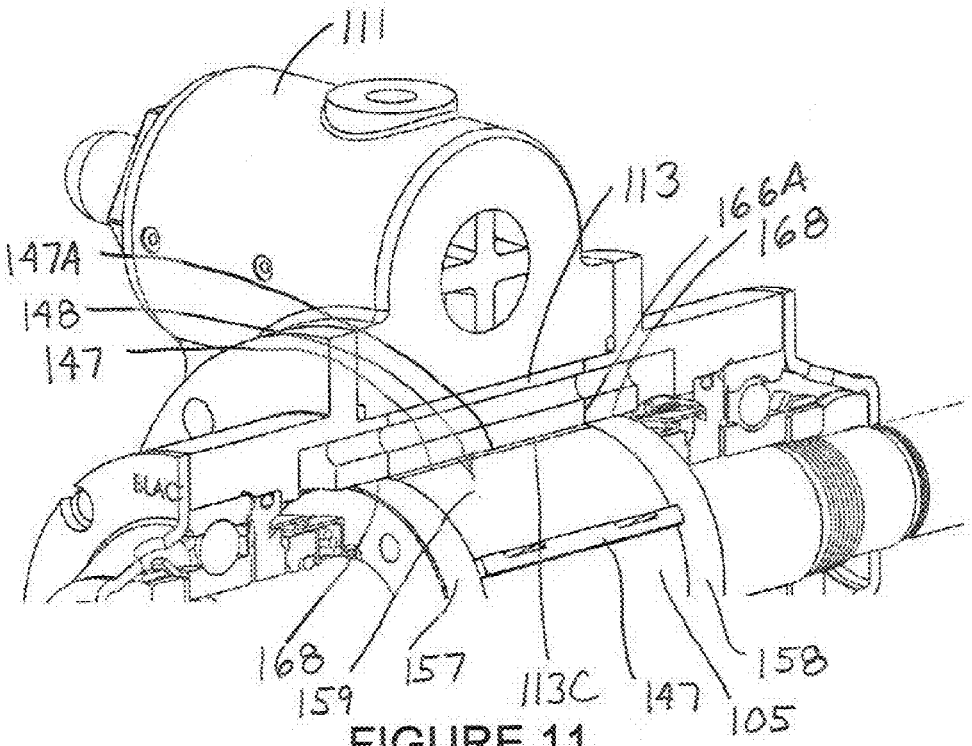
FIG. 11 is a partial, enlarged cross-sectional perspective view of an upper portion of the pump.
Figure 12:
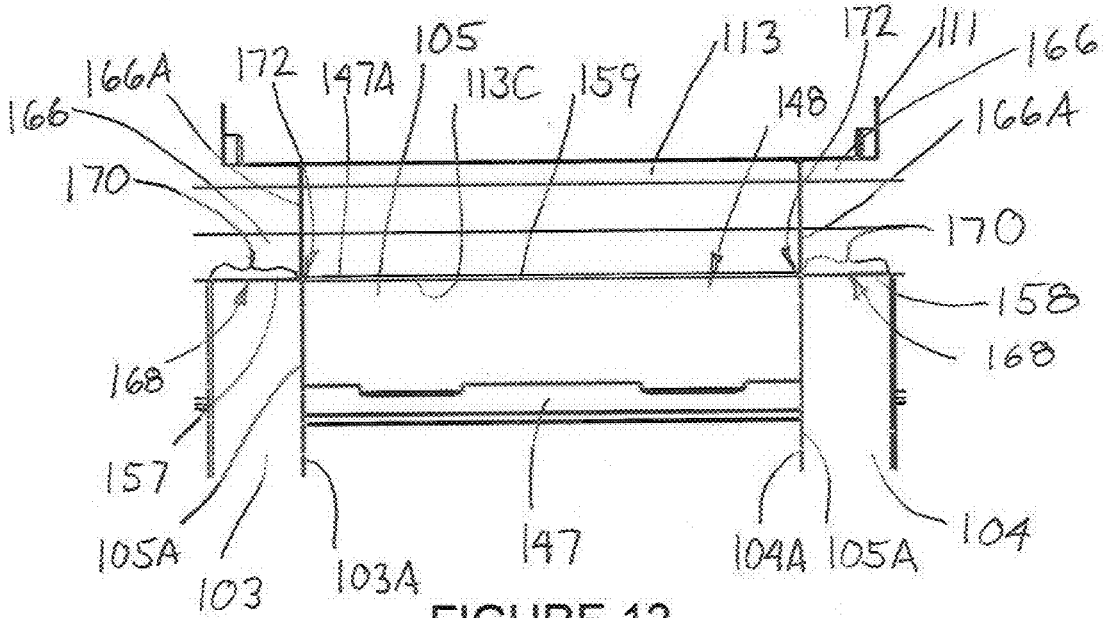
FIG. 12 is an enlarged cross-sectional view showing the cooperation of the rotor with a liner.

Referring to FIGS. 10, 11 and 12, the radial clearance 168 extends along an axial length indicated by reference brackets 170. This axial length is generally defined by thickness of the discs 103 and 104. Since the outer disc surfaces 161 and 162 rotate relative to the stationary head surfaces 163 and 164, the dynamic, relative movement impedes fluid leakage through the clearances 168 to thereby define a dynamic seal. This dynamic seal is provided along each outside disc diameter 157 and 158 instead of the axially-directed faces 103A, 104A and 105A (FIGS. 12 and 16) of the discs 103 and 104 and the rotor 105 positioned axially therebetween. Because of the tight compression of the rotor 105 between the discs 103 and 104 by the bolts 156, no process fluid is able to leak between these opposed surfaces 103A, 104A and 105A and no hydraulic slip occurs therebetween. It will be understood that while the discs 103 and 104 are most likely to be affixed to the rotor 105 using fasteners 156, these components could be affixed using other means or made from one piece with the rotor or shaft sections 125 and 126.

Referring to FIGS. 10, 11 and 12, the upper region of the rotor 105 shown therein has the inside liner face 113C of the liner 113 located radially adjacent to the outer rotor diameter 159. The liner face 113C has a small radial space defined by the fluid cavity 148 between the liner face 113C and rotor diameter 159, which space is closed by the vane 147 which extends radially therebetween. Due to continuous contact of the outer edge 147A of the vane 147 with the liner face 113C, pumping occurs and very little leakage or slip occurs between the fluid cavities.

Figure 13:
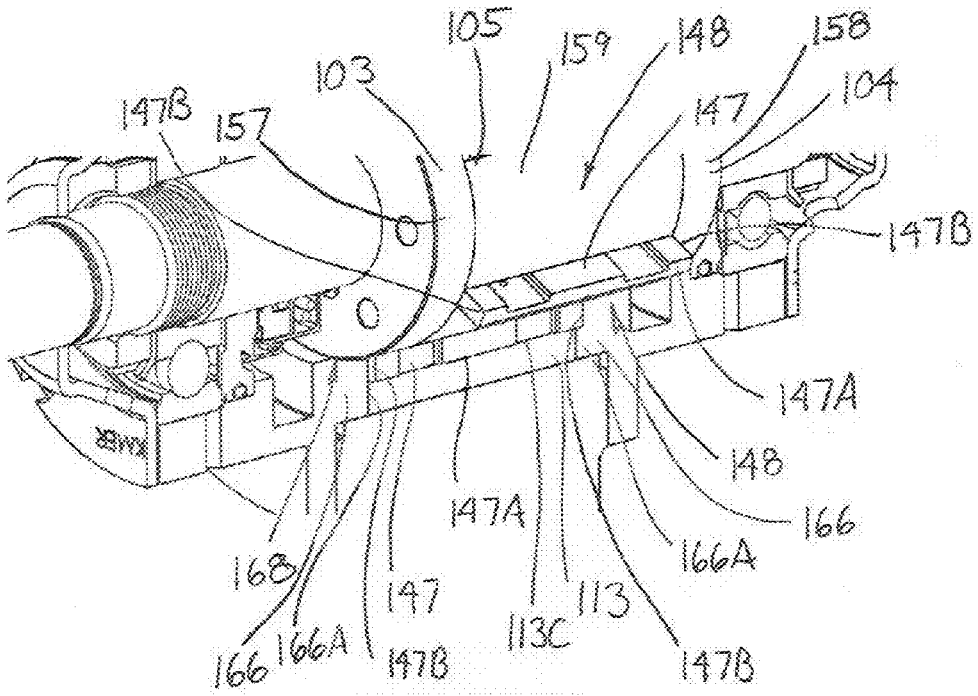
FIG. 13 is a partial cross-sectional view showing a bottom portion of the pump.
Figure 14:
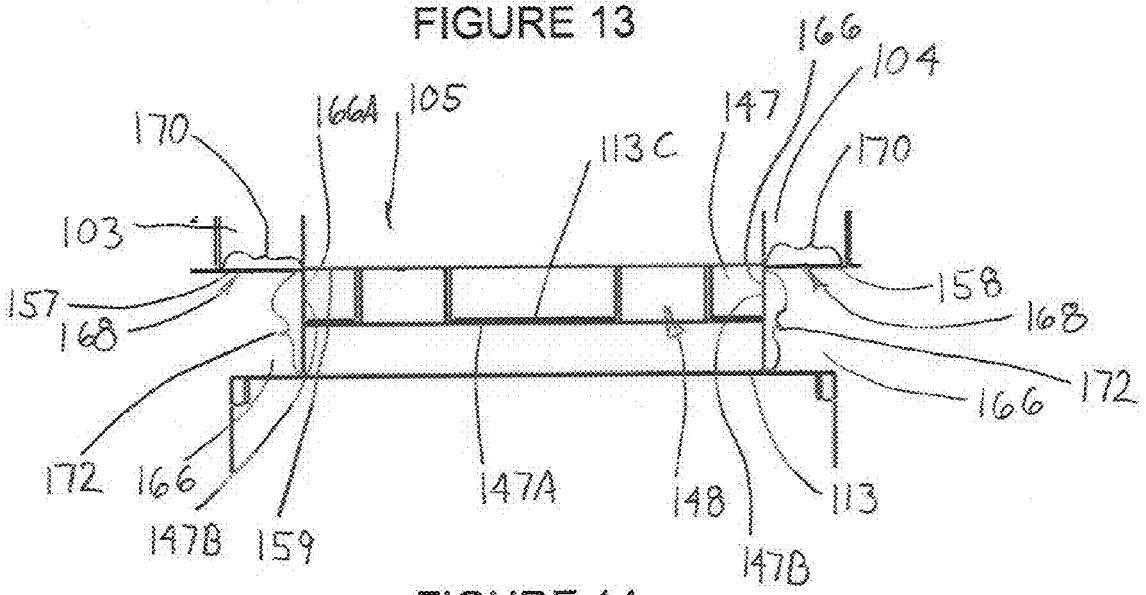
FIG. 14 is a side-cross-sectional view thereof.

On the diametrically opposite, bottom side of the rotor 105 as seen in FIGS. 10, 13 and 14, the radial space between the liner face 113C and rotor diameter 159 is substantially greater due to the eccentric shape of the liner 113. This space is at its largest radial dimension at this location as the fluid cavity 148 travels about the circumference of the rotor 105, and this space is closed by the vane 147 which projects radially outwardly into contact with the liner face 113C. In particular, the vane edge 147A rides circumferentially in contact with the liner face 113C during shaft rotation since vane 147 is able to reciprocate into and out of the vane slot 146 in conformance with the eccentric profile of the liner 113.

As seen in FIGS. 13 and 14, the vane 147 projects radially outwardly beyond rotor diameter 159 and has vane side edges 147B which travel along the stationary flange face 166A, which flange face 166A is defined by the above-described head flange 166 that forms the dynamic clearances 168. The movable vane edges 147B and stationary flange faces 166A have a radial length indicated by reference brackets 172 in FIG. 14. The radial length 172 is shown at its maximum in FIG. 14 and its minimum in FIG. 12, and progressively increases and decreases as each vane 147 moves circumferentially during shaft rotation between the two positions of FIGS. 12 and 14. Since there is some axial space provided between the vanes 147 and faces 166A, some slip may occur in this region, but overall the amount of slip is limited by the small magnitude of the radial length 172. Some slip might also occur along the axially-extending vane edges 147A.

With this design, the discs 103 and 104 rotate with the rotor 105 and the end clearances found in the prior art are eliminated. This thereby eliminates the formation of slip between such end surfaces. In comparison to prior art pump designs, the present invention has shown substantial improvement in flow rate efficiency.

More particularly in the inventive design, the path of fluid traveling from the high pressure pump side near the outlet 16 to the low pressure side of the pump 10 near the inlet 15 is controlled by using the radial clearances 168 that are defined between the outside diameters 157 and 158 of the discs 103 and 104 and the inside diameters 163 and 164 of the stationary heads 121 and 122.

Figure 2:
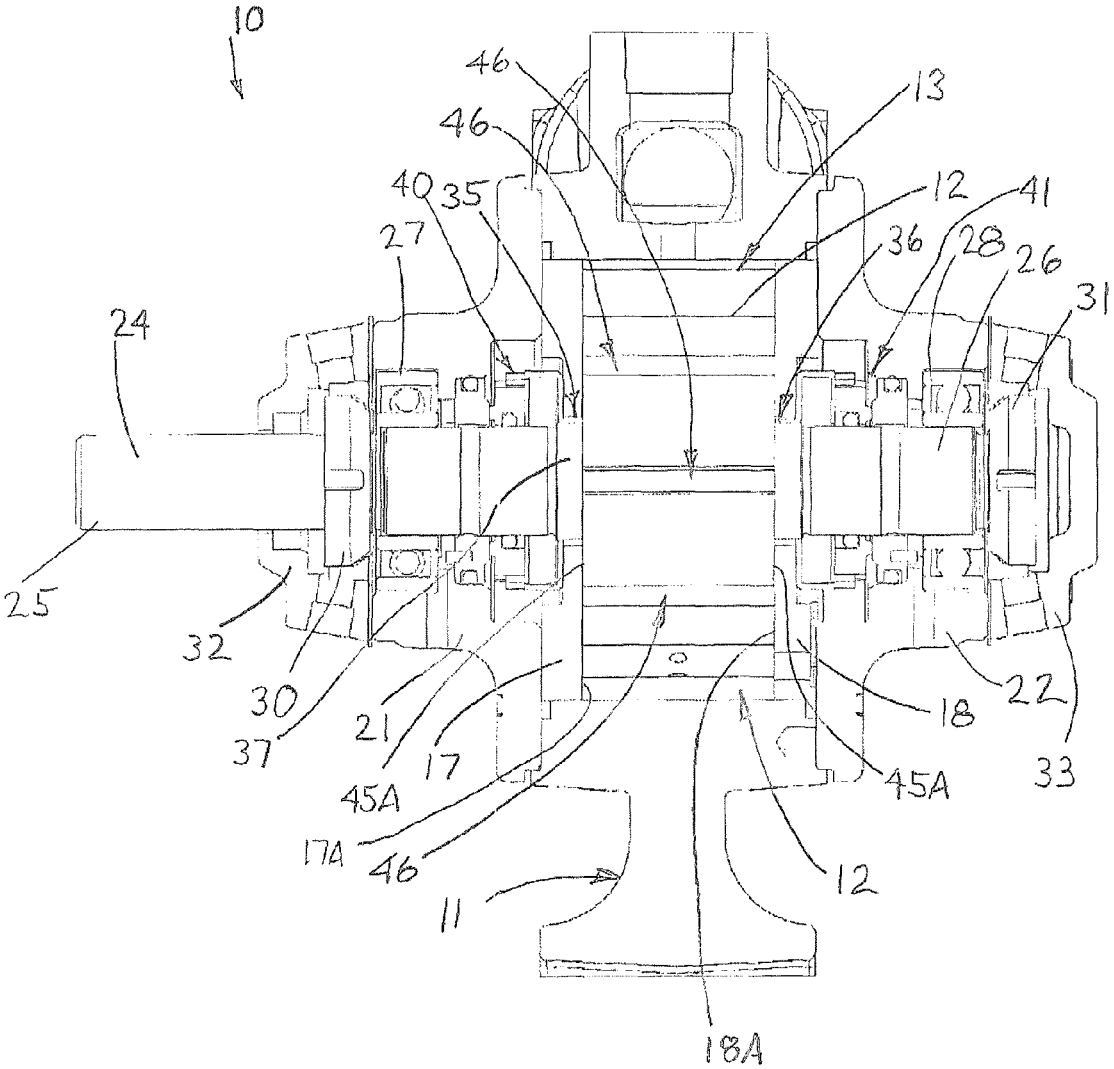
FIGURE 2 PRIOR ART
FIG. 2 is a side cross-sectional view of the pump of FIG. 1.

The design of the invention provides a number of benefits. Since the axial end clearances are eliminated in comparison to prior art pumps such as that illustrated in FIGS. 1 and 2, the reliance upon the radial clearance 168 at the OD of each disc 103 and 104 allows for larger machining tolerances and/or internal pump clearances to improve machining cost and assembly. This also improves pump durability when it is necessary to use materials that are sensitive to galling such as stainless steel, which may be used for the discs 103 and 104 and each head 121 and 122. There also is a lower amount of vane contact/wear on the vane width between the vane edges 147B and other structure, since the discs 103 and 104, rotor 105, and shaft 106 are axially located and set together during assembly and bolting with the bolts 156.

Additional advantages also exist. For example, the outer diameter 159 of the rotor 105 still may be much larger than shaft 106, and since the discs 103 and 104 are bolted or otherwise affixed to the rotor 105 and rotate with rotor shaft 106, this eliminates the axial end faces. Clearances can be more precisely controlled by relying upon the radial clearances 168, and perpendicularity tolerance of the rotor 105 is less important since the end clearances are eliminated in the inventive design.

Since the disc outside diameters 157 and 158 are defined and located within each head 121 and 122, the dynamic clearance is now defined by and controlled on the OD 157/158 of the respective disc 103/104 and the ID 163/164 of the respective head 121/122. These diameters can be easily machined in one operation which allows for precise location and size of the head and disc diameters.

Also, locating the clearances on the diameter creates a torturous flow path since any slip must flow circumferentially around the vanes 147 which improves flow lost due to slip. Still further, since end clearances are eliminated, axial pump clearances can be increased which improves assembly and field repairability.

In addition to the preferred design described herein, other alternate configurations are disclosed. For example, the disc outside diameters 157 and 158 can be designed to further eliminate slip such as by providing a helical dynamic excluder (pump) or a labyrinth seal (multiple steps) to impede fluid flow through the radial clearances 168.

If desired, discs 103 and 104 can be non-metallic or dissimilar metals while still avoiding galling or damage. If desired, metallic discs 103 and 104 may be used depending on application, and providing a relatively small disc thickness in relation to a metallic rotor 105 reduces issues with thermal expansion of plastics used in metallic housings.

While fasteners 156 are used, each disc 103 and 104 may be affixed using another method (adhesive, weld, thread onto shaft or rotor). Also, holes may be provided in the discs 103 and 104 which holes may be used to pressure energize vanes 146 or a seal cavity surrounding the seals 140 and 141.

Figure 17:
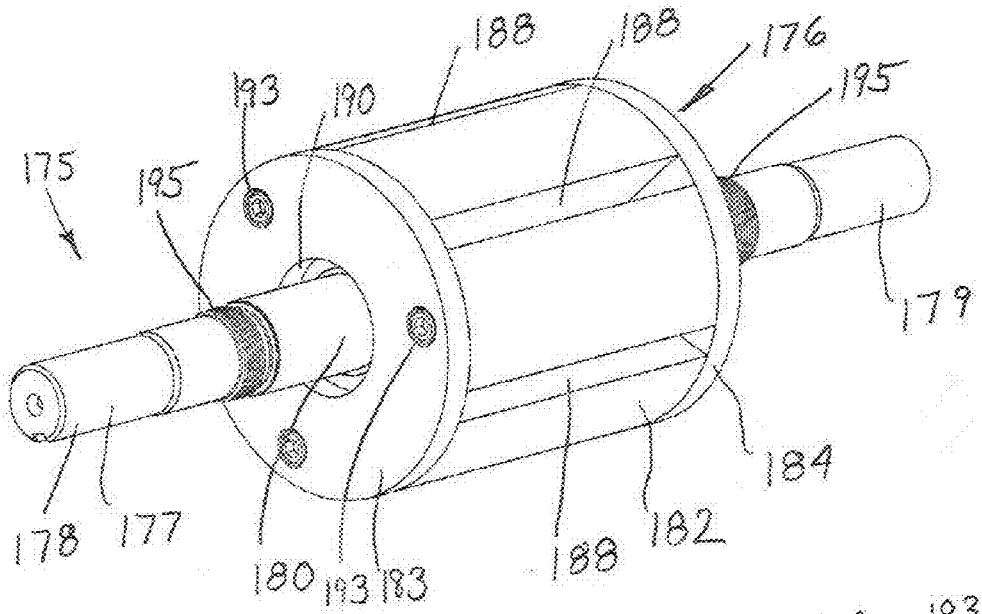
FIG. 17 is a perspective view of a further embodiment of a rotor/shaft assembly.
Figure 18:
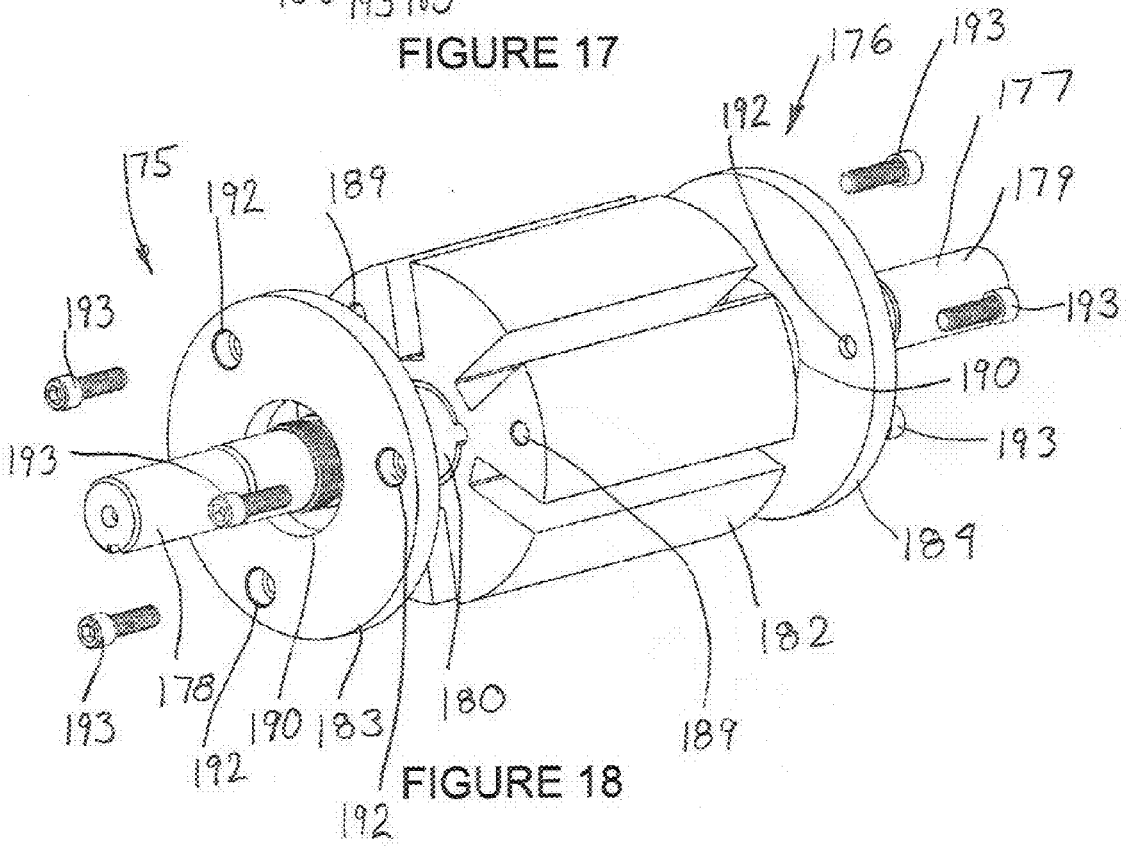
FIG. 18 is an exploded view thereof.

In an alternate design for a rotor/shaft assembly shown in FIGS. 17 and 18, the rotor/shaft assembly 175 may include a rotor/disc assembly 176 that is affixed to shaft 177. In this configuration, the shaft 177 is a single rod-like member which has a length corresponding to the total length of the above-described shaft 106 that is formed by the two shaft sections 125 and 126 coupled to the intermediate rotor 105. In this alternate design, the shaft 177 has projecting end portions 178 and 179 which are monolithically formed with an intermediate shaft body 180

The rotor/disc assembly 176 comprises a rotor 182 and two discs 183 and 184, wherein the rotor/disc assembly 176 can be slid axially on the shaft 177. The rotor 182 includes a shaft bore 186 which receives the shaft 177 therethrough. To form the interference fit, the rotor 182 is heated and expands so that it can be slid onto the shaft, and then cools and contracts so that the rotor 182 is affixed to and rotates in unison with the shaft 177. The rotor 182 also includes vane slots 188 and threaded fastener bores 189 which extend at least partially through the rotor 182.

The discs 183 and 184 are formed as annular plates which include a central hub opening 190 through which the shaft 177 extends. In the illustrated embodiment, the discs 183 and 184 include fastener holes 192 which align with the rotor bores 189 so that the discs can be affixed to the rotor 182 by fasteners 193.

The final assembly of FIGS. 17 and 18 is similar to the rotor/shaft assembly 102 above. The axial location of the rotor/disc assembly 176 in relation to the heads 121 and 122 would be accomplished by precisely controlling the axial width of the rotor/disc assembly 176 to ensure that the discs 183 and 184 will not contact the heads 121 and 122 during pump operation. The axial position may be fixed during assembly as the locknuts 130 and 131 are attached to the threaded shaft portions 195.

Figure 19:
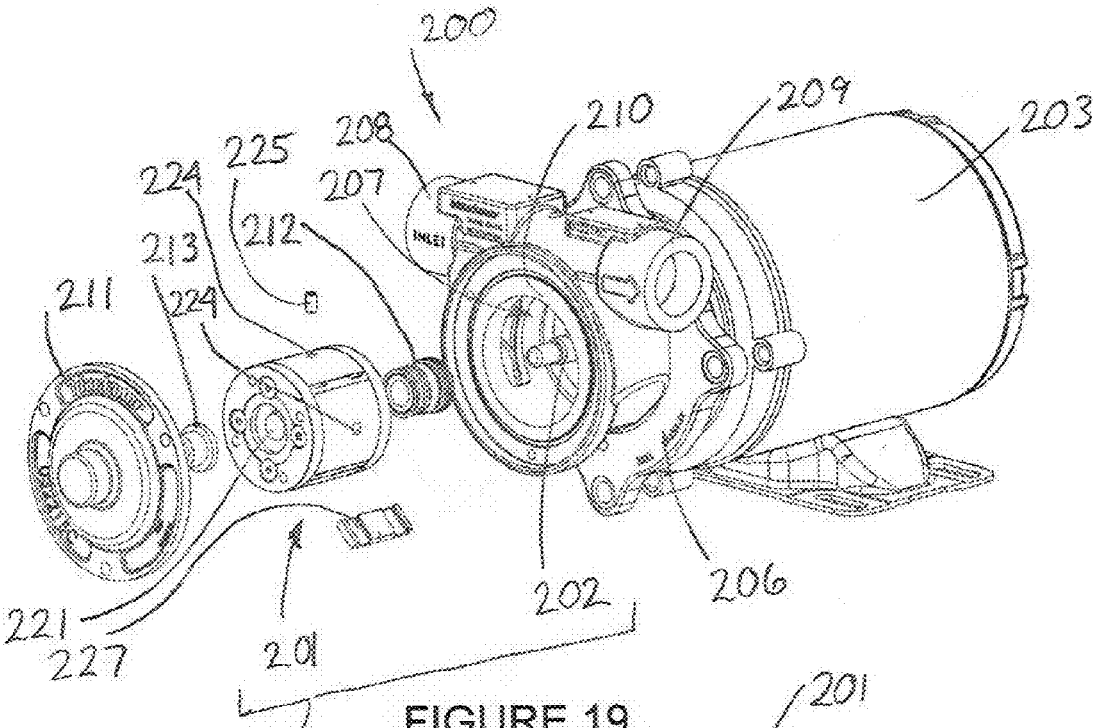
FIG. 19 is an exploded view of a pump in a further embodiment.
Figure 20:
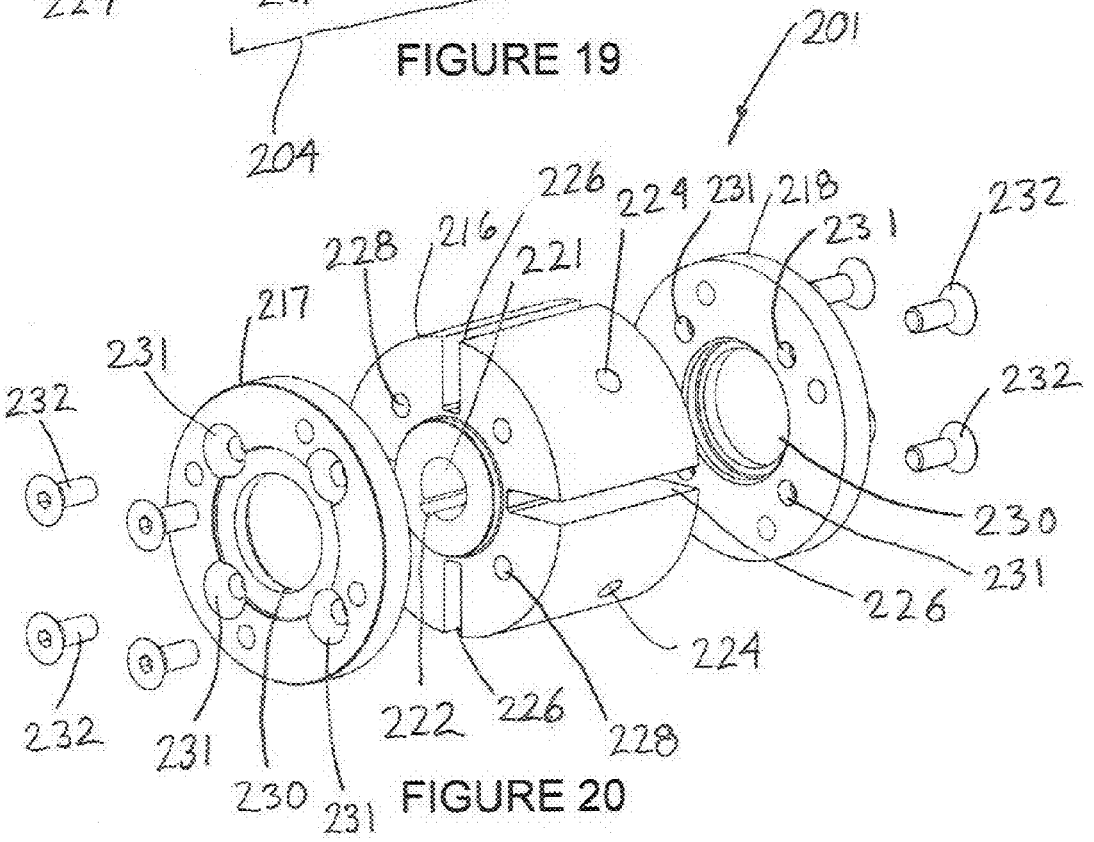
FIG. 20 is an exploded view of a rotor assembly of the pump of FIG. 19.
Figure 21:
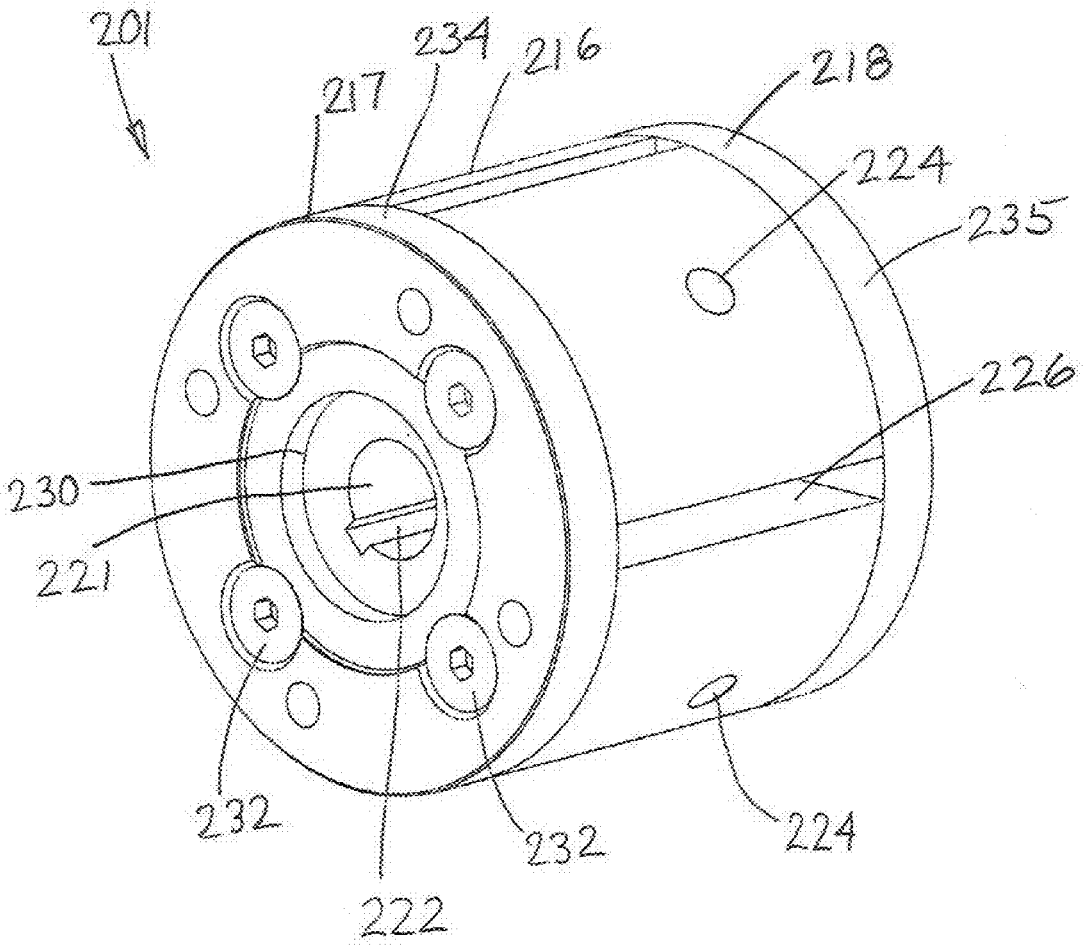
FIG. 21 is a perspective view of the rotor assembly.

A further alternate design is illustrated in FIGS. 19, 20 and 21. In this design, a pump 200 includes a rotor/disc assembly 201 that is mounted to a pre-existing motor shaft 202 of a motor 203 to thereby form a rotor/shaft assembly 204. Hence, the rotor/shaft assembly 204 may encompass a shaft which is integral with a motor or a separate shaft that is connected later to a motor shaft during installation of a pump.

In the alternate design of FIGS. 19, 20 and 21, the pump 200 has its casing 206 mounted to one end of the motor 203 wherein the motor shaft 202 projects into the pump chamber 207. The pump 200 includes an inlet 208 and outlet 209, a liner 210 and a head 211, and in many respects, functions the same as pump 100. As such, a detailed discussion of such pump 200 and motor 203 is not required herein. Generally, only one mechanical seal 212 is provided on the motor shaft 202 to protect from leakage into motor 203, and only one bearing 213 is provided since the motor shaft 202 is already supported by a motor bearing internally within the motor 203.

The rotor/disc assembly 201 comprises a rotor 216 and two discs 217 and 218, wherein the rotor/disc assembly 201 is slid axially onto the free end of the motor shaft 202 and is rotationally driven by a drive formation on the shaft 202 which can be formed as a key, pin, or spline between the shaft 202 and rotor 216. The rotor 216 includes a shaft bore 221 which includes a drive groove 222 that engages the complementary drive formation so that the rotor 216 rotates in unison with the shaft 202. The rotor 216 includes several radial fixing bores 224 which each receives a set screw 225 that is driven radially into engagement with the shaft 202 during installation. This fixes the rotor/disc assembly 201 in a defined axial position on the shaft 202 although it may be desirable to not use set screws 225 and allow the rotor/disc assembly 201 to float on the shaft 202, wherein fluid would hydraulically separate the discs 217 and 218 from axially adjacent structures.

The rotor 216 also includes vane slots 226, which receive vanes 227 therein, and threaded fastener bores 228 which extend at least partially through the rotor 216.

The discs 217 and 218 are formed as annular plates which include a central hub opening 230 through which the shaft 202 extends. In the illustrated embodiment, the discs 217 and 218 include fastener holes 231 which align with the rotor bores 228 so that the discs 217 and 218 can be affixed to the rotor 216 by fasteners 232.

The rotor/disc assembly 201 is preassembled with the fasteners 232, and then this unit is slid onto the motor shaft 202 and fixed in position by set screws 225. Like the pump designs of the invention described above, the outside diameters 234 and 235 of the discs 217 and 218 are located closely adjacent to inward facing surfaces in the pump casing 206. Hence, the rotor/shaft assembly 204 functions in the same manner as described above.

Although particular preferred embodiments of the invention have been disclosed in detail for illustrative purposes, it will be recognized that variations or modifications of the disclosed apparatus, including the rearrangement of parts, lie within the scope of the present invention.

We claim:

1. A sliding-vane positive displacement pump, comprising:

a housing assembly having a casing which defines a pumping chamber, and having an inlet and an outlet which respectively open into and out of said pumping chamber to permit pumping of a process fluid between said inlet and said outlet, said pumping chamber having an annular chamber face which faces radially inwardly and has an eccentric profile when viewed axially, and having opposite open ends which open axially from opposite sides of said chamber, said housing assembly including first and second heads which mount to said casing over said open ends, each of said first and second heads having a circular inside head surface, wherein said inside head surfaces face radially inwardly and define head openings which open axially and define a respective inside head diameter;

a rotatable shaft extending into said pumping chamber through at least one of said head openings; and a rotor/disc assembly which is mounted to said shaft and disposed within said pumping chamber to effect said pumping of a process fluid, said rotor/disc assembly comprising:

a rotor mounted to said shaft which has a circumferential rotor surface facing radially outwardly toward the chamber face and has opposite rotor end faces which face axially toward said head openings, said rotor including a plurality of vane slots which are circumferentially spaced apart and open radially from said rotor surface and axially through said rotor end faces, said vane slots including radially slidable vanes which reversibly slide radially outwardly into continuous contact with said chamber face during shaft rotation and define pumping cavities circumferentially between said vanes; and opposite end discs which mount face wise over the entirety of said rotor end faces and close off opposite axial ends of said vane slots, said end discs being affixed to said rotor end faces to prevent leakage of process fluid and hydraulic slip face wise over an entirety of said rotor end faces during shaft rotation, each of said end discs having an outside disc face wherein said outside disc faces face radially outwardly in direct facing relation with said inside head surfaces so as to be closely adjacent said inside head surfaces and define a small radial clearance therebetween which forms a dynamic seal during rotation of said rotor and impedes leakage of process fluid axially through said radial clearance, said vanes projecting radially outwardly beyond said outside disc faces during shaft rotation, said rotor surface and said outside disc faces being respectively defined by a rotor outer diameter and disc outer diameters, said rotor outer diameter and said disc outer diameters being closely proximate to each other and less than but closely proximate to said inside head diameters wherein said vanes project radially outwardly beyond said rotor surface and said outside disc faces.

2. The pump according to claim 1, wherein said head assembly includes an annular liner which fits within said casing and defines said chamber face and said pumping chamber.

3. The pump according to claim 2, wherein said liner is captured axially between said first and second heads, said chamber face extending radially outwardly of said inside head surfaces.

4. The pump according to claim 3, wherein said chamber face defines said eccentric profile as viewed through said open ends.

5. The pump according to claim 1, wherein said shaft comprises shaft sections on opposite sides of said rotor, wherein each of said first and second heads includes a bearing unit supporting a respective one of said shaft sections.

6. The pump according to claim 1, wherein said rotor outer diameter and said disc outer diameters being proximate to but less than said head inside diameters so as to terminate said rotor and said end discs radially inwardly of said inside head surfaces with said first and second heads being free of slip-permitting surfaces facing axially toward said end discs and said rotor.

7. A sliding-vane positive displacement pump, comprising:

a housing assembly having a casing which defines a pumping chamber, and having an inlet and an outlet which respectively open into and out of said pumping chamber to permit pumping of a process fluid between said inlet and said outlet, said pumping chamber having an annular chamber face which faces radially inwardly, and having opposite open ends which open axially from opposite sides of said chamber, said housing assembly including first and second heads which mount to said casing over said open ends, each of said first and second heads having an annular inside head surface, wherein said inside head surfaces face radially inwardly and define head openings which open axially and define respective head inside diameters;

a rotatable shaft extending into said pumping chamber through said head openings; and a rotor/disc assembly which is mounted to said shaft and disposed within said pumping chamber to effect said pumping of a process fluid, said rotor/disc assembly comprising:

a rotor mounted to said shaft which has a circumferential rotor surface facing radially outwardly toward the chamber face and has opposite rotor end faces which face axially toward said head openings, said rotor including a plurality of vane slots which are circumferentially spaced apart and open radially from said rotor surface and axially through said rotor end faces, said vane slots including radially slidable vanes which reversibly slide radially outwardly into continuous contact with said chamber face during shaft rotation and define pumping cavities circumferentially between said vanes; and opposite end discs which mount face wise over said rotor end faces and close off opposite axial ends of said vane slots, said end discs being affixed to said rotor end faces to prevent leakage of process fluid and hydraulic slip face wise over said rotor end faces during shaft rotation, each of said end discs having an outside disc face wherein said outside disc faces face radially outwardly in direct facing relation with said inside head surfaces and have disc outer diameters closely adjacent to but smaller than said head inside diameters to define a small radial clearance therebetween which forms a dynamic seal that impedes leakage of process fluid axially through said radial clearance, said vanes projecting radially beyond said outside disc faces in said continuous contact with said chamber face;

said rotor surface and said outside disc faces being respectively defined by a rotor outer diameter and said disc outer diameters and said inside head surfaces being respectively defined by said head inside diameters, said rotor outer diameter and said disc outer diameters being closely proximate to but less than said head inside diameters such that said rotor does not extend radially beyond said head inside diameters and said disc outer diameters, and said first and second heads are free of slip-permitting surfaces facing axially toward said end discs and said rotor.

8. The pump according to claim 7, wherein said head assembly includes an annular liner which fits within said casing and defines said chamber face and said pumping chamber.

9. The pump according to claim 8, wherein said liner is captured axially between said first and second heads, said chamber face extending radially outwardly of said inside head diameters.

10. The pump according to claim 9, wherein said chamber face has an eccentric profile as viewed through said open ends.

11. The pump according to claim 7, wherein said shaft comprises shaft sections on opposite sides of said rotor, wherein each of said first and second heads includes a bearing unit supporting a respective one of said shaft sections.

12. A sliding-vane positive displacement pump, comprising:

a housing assembly having a casing which defines a pumping chamber, and having an inlet and an outlet which respectively open into and out of said pumping chamber to permit pumping of a process fluid between said inlet and said outlet, said pumping chamber having an annular chamber face which faces radially inwardly, and opposite open ends which open axially from opposite sides of said chamber, said housing assembly including first and second heads which mount to said casing over said open ends, each of said first and second heads having an annular inside head surface, wherein said inside head surfaces face radially inwardly and define head openings which open axially through a respective axial thickness of said first and second heads;

a rotatable shaft extending into said pumping chamber through at least one of said head openings; and a rotor/disc assembly which is mounted to said shaft and disposed within said pumping chamber to effect said pumping of a process fluid, said rotor/disc assembly comprising:

a rotor mounted to said shaft which has a circumferential rotor surface facing radially outwardly toward the chamber face to define an outer rotor diameter and has opposite rotor end faces which face axially toward said head openings, said outer rotor diameter permitting said rotor to be slid axially through one of said head openings, said rotor including a plurality of vane slots which are circumferentially spaced apart and open radially from said rotor surface and axially through said rotor end faces, said vane slots including radially slidable vanes which reversibly slide radially outwardly into continuous contact with said chamber face during shaft rotation and define pumping cavities circumferentially between said vanes; and opposite end discs which mount face wise over said rotor end faces and close off opposite axial ends of said vane slots, said end discs being affixed to said rotor end faces to prevent leakage of process fluid and hydraulic slip face wise over an entirety of said rotor end faces during shaft rotation, each of said end discs having an outside disc face wherein said outside disc faces face radially outwardly in direct facing relation with said inside head surfaces, and said outside disc faces are disposed closely adjacent to but radially inwardly of said inside head surfaces to define a radial clearance along said axial head thickness which said radial clearance permits said end discs to fit axially into said head openings and impedes leakage of process fluid axially through said radial clearance and permits axial movement of said rotor/disc assembly relative to said first and second heads without interference with said first and second heads, said vanes projecting radially beyond said outside disc faces in said continuous contact with said chamber face.

13. The pump according to claim 12, wherein said head assembly includes an annular liner which fits within said casing and defines said chamber face and said pumping chamber, said liner being captured axially between said first and second heads, and said chamber face extending radially outwardly of said inside head surfaces.

14. The pump according to claim 13, wherein said vanes project radially outwardly beyond said rotor surface and in addition to said outside disc faces, and said vanes are slidable into and out of said vane slots during shaft rotation to maintain said continuous contact with said chamber face.

15. The pump according to claim 12, wherein said shaft comprises shaft sections on opposite sides of said rotor, wherein each of said first and second heads includes a bearing unit supporting a respective one of said shaft sections.

16. The pump according to claim 15, wherein said shaft sections are defined at opposite ends of said shaft wherein said shaft is insertable through a central shaft opening of said rotor so that said shaft section project from opposite sides of said rotor.

17. The pump according to claim 15, wherein said shaft sections are formed separate of each other and each have an inboard end affixed to a respective one of said end discs wherein said shaft sections are affixed to said rotor by fastening said end discs to said rotor.

18. The pump according to claim 17, wherein said end discs are joined together by fasteners which extend axially into respective fastener bores within said rotor.

19. A sliding-vane positive displacement pump, comprising:

a housing assembly having a casing which defines a pumping chamber, and having an inlet and an outlet which respectively open into and out of said pumping chamber to permit pumping of a process fluid between said inlet and said outlet, said pumping chamber having an annular chamber face which faces radially inwardly, and opposite open ends which open axially from opposite sides of said chamber, said housing assembly including first and second heads which mount to said casing over said open ends, each of said first and second heads having an annular inside head surface, wherein said inside head surfaces face radially inwardly and define head openings which open axially;

a rotatable shaft extending into said pumping chamber through said head openings, said shaft comprising shaft sections wherein each of said first and second heads includes a bearing unit supporting a respective one of said shaft sections;

a rotor/disc assembly which is mounted to said shaft and disposed within said pumping chamber to effect said pumping of a process fluid, said rotor/disc assembly comprising:

a rotor mounted to said shaft which has a circumferential rotor surface facing radially outwardly toward the chamber face and has opposite rotor end faces which face axially toward said head openings, said rotor including a plurality of vane slots which are circumferentially spaced apart and open radially from said rotor surface and axially through said rotor end faces, said vane slots including radially slidable vanes which reversibly slide radially outwardly into continuous contact with said chamber face during shaft rotation and define pumping cavities circumferentially between said vanes;

opposite end discs which mount face wise over an entirety of said rotor end faces and close off opposite axial ends of said vane slots without extending radially beyond said rotor surface, each of said end discs having a respective one of said shaft sections affixed thereto wherein said shaft sections in turn are affixed to said rotor by fastening said end discs to said rotor with fasteners which extend axially into respective fastener bores within said rotor, said end discs being affixed to and covering said rotor end faces to prevent leakage of process fluid and hydraulic slip face wise over said rotor end faces during shaft rotation; and each of said end discs having an outside disc face wherein said outside disc faces face radially outwardly in direct facing relation with and closely adjacent to said inside head surfaces to define a small radial clearance therebetween which impedes leakage of process fluid axially through said radial clearance, said rotor terminating radially so as to not extend beyond said head inside diameters with said entirety of said rotor end faces being covered by said end discs to prevent facewise slip over any portion of said rotor end faces.

20. The pump according to claim 19, wherein said rotor surface and said outside disc faces are respectively defined by a rotor outer diameter and disc outer diameters and said inside head surfaces are respectively defined by head inside diameters, said disc outer diameters being closely adjacent to but less than said head inside diameters by said radial clearance to permit axial movement of said rotor/disc assembly relative to said first and second heads without interference therebetween.

21. The pump according to claim 20, wherein said rotor outer diameter and said disc outer diameters are closely proximate to each other such that said vanes project radially outwardly beyond said rotor surface and said outside disc faces and only said vanes of said rotor/disc assembly extends beyond said head inside diameters, said vanes being slidable into and out of said vane slots during shaft rotation to maintain continuous contact with said chamber face.

* * * * *